US010001342B2

(12) United States Patent
Sharrah et al.

(10) Patent No.: US 10,001,342 B2
(45) Date of Patent: Jun. 19, 2018

(54) MODULAR LIGHT MOUNTABLE ON A HANDGUN

(71) Applicant: STREAMLIGHT, INC., Eagleville, PA (US)

(72) Inventors: Jonathan R. Sharrah, Collegeville, PA (US); William D. Worman, Phoenixville, PA (US)

(73) Assignee: Streamlight, Inc., Eagleville, PA (US)

( * ) Notice: Subject to any disclaimer, the term of this patent is extended or adjusted under 35 U.S.C. 154(b) by 0 days. days.

(21) Appl. No.: 15/283,788

(22) Filed: Oct. 3, 2016

(65) Prior Publication Data

US 2018/0094900 A1 Apr. 5, 2018

(51) Int. Cl.
*F41G 1/35* (2006.01)
*F41A 19/11* (2006.01)
*F41G 1/54* (2006.01)

(52) U.S. Cl.
CPC ..... *F41G 1/35* (2013.01); *F41A 19/11* (2013.01); *F41G 1/545* (2013.01)

(58) Field of Classification Search
CPC ..... F41G 11/001; F41G 11/003; F41G 1/35; F41G 1/34; F41G 19/11; F41G 1/545
See application file for complete search history.

(56) References Cited

U.S. PATENT DOCUMENTS 4,177,754 A 12/1979 James et al.
5,042,186 A 8/1991 Bechtel
5,581,898 A * 12/1996 Thummel ..... F41G 1/35 42/114
5,628,555 A 5/1997 Sharrah et al.
5,685,105 A * 11/1997 Teetzel ..... F41A 9/62 362/114
5,758,448 A * 6/1998 Thummel ..... F41G 1/36 362/114
5,787,628 A * 8/1998 Teetzel ..... F41H 9/10 222/79
6,154,995 A * 12/2000 Lenoir ..... F41A 17/54 42/70.07
6,230,431 B1 * 5/2001 Bear ..... F41G 1/35 362/114

(Continued)

FOREIGN PATENT DOCUMENTS

EP 3045857 A1 * 7/2016 ..... F41G 11/004

OTHER PUBLICATIONS

Laserlyte, "Sight TGL DB .380/9MM Tan", printed Jan. 13, 2015, 4 pages, http://www.laserlyte.com/products/sight-tgl-diamondback-380-9mm-tan.

(Continued)

*Primary Examiner* — Benjamin P Lee
(74) *Attorney, Agent, or Firm* — Clement A. Berard, Esq.; Dann, Dorfman, Herrell & Skillman, PC

(57) ABSTRACT

A light mountable on a handgun may comprise: a light housing including one or more light sources, a cavity for a source of electrical power, a switch, and a circuit for energizing the light sources. The light housing has complementary parts configured to enclose a part of the handgun and a mounting rail, and may include an access cover that is openable when the light is mounted on a handgun, for placing and removing the source of electrical power. Light sources may include an illumination source and/or an aiming source.

27 Claims, 13 Drawing Sheets

(56) References Cited

U.S. PATENT DOCUMENTS 6,276,088 B1 * 8/2001 Matthews ..... F21L 4/005 362/110
D567,894 S 4/2008 Sterling
7,726,061 B1 6/2010 Thummel
7,735,255 B1 * 6/2010 Kincaid ..... F41C 33/0254 362/110
7,934,333 B1 * 5/2011 Tuz ..... F41C 9/02 42/96
8,169,165 B2 5/2012 West
8,256,154 B2 * 9/2012 Danielson ..... F41A 19/11 42/117
D674,858 S 1/2013 Galli
8,510,979 B1 * 8/2013 Mortimer ..... F41H 9/10 42/1.08
8,683,731 B2 * 4/2014 Kowalczyk ..... G01B 11/27 42/111
8,683,733 B2 * 4/2014 Gross ..... F41C 23/16 362/110
8,713,844 B2 * 5/2014 Tuller, Jr. ..... F41G 1/00 42/111
8,760,085 B2 6/2014 West
D709,981 S 7/2014 Johnston
8,904,698 B2 12/2014 Riley
8,915,009 B2 12/2014 Caulk
9,035,576 B2 5/2015 West
D738,455 S 9/2015 Homem de Mello Anderson
D738,457 S 9/2015 Johnston
9,182,194 B2 * 11/2015 Moore ..... F41C 23/16
9,341,440 B2 * 5/2016 Moore ..... F41C 23/16
9,488,439 B2 11/2016 Galli
9,658,031 B1 5/2017 Hedeen
2002/0100204 A1 * 8/2002 Kim ..... F41G 1/35 42/146
2002/0148153 A1 10/2002 Thorpe
2005/0246937 A1 * 11/2005 Kim ..... F41G 11/003 42/146
2008/0120891 A1 * 5/2008 Wei ..... F41G 11/003 42/90
2009/0013580 A1 1/2009 Houde-Walter et al.
2012/0124885 A1 * 5/2012 Caulk ..... F41G 1/35 42/146
2012/0144718 A1 * 6/2012 Danielson ..... F41A 19/11 42/117
2013/0074351 A1 * 3/2013 Kowalczyk ..... G01B 11/27 33/286
2013/0145672 A1 * 6/2013 Tuller, Jr. ..... F41G 1/00 42/114
2015/0102743 A1 4/2015 West
2015/0113851 A1 * 4/2015 Bensayan ..... F41A 17/063 42/117
2015/0159847 A1 * 6/2015 Galli ..... F21V 23/0414 362/111
2015/0192391 A1 7/2015 Moore
2015/0233668 A1 * 8/2015 Moore ..... F41C 23/16 42/72
2015/0276347 A1 * 10/2015 Sharrah ..... F41G 1/35 42/117
2015/0276352 A1 10/2015 Chang et al.
2016/0021329 A1 * 1/2016 Sakiewicz ..... H04N 5/772 386/227
2016/0209167 A1 * 7/2016 Wells ..... F41C 27/00
2016/0209168 A1 7/2016 Sharrah et al.
2016/0305742 A1 * 10/2016 Kowalczyk, Jr. ..... G01B 11/27

OTHER PUBLICATIONS

Laserlyte, "Glock Lasers", printed Jan. 13, 2015, 1 page, http://www.laserlyte.com/collections/glock.
Laserlyte, "Springfield XD/XDM/XDS Lasers", printed Jan. 13, 2015, 1 page, http://www.laserlyte.com/collections/xd-xdm-xds.
Laserlyte, "SCCY Laser Sight", printed Jan. 13, 2015, 1 page, http://www.laserlyte.com/collections/sccy-laser-sight.
Laserlyte, "Hi-Point Laser", printed Jan. 13, 2015, 1 page, http://www.laserlyte.com/collections/hi-point-laser.
Laserlyte, "Closeouts", printed Jan. 13, 2015, 1 page, http://www.laserlyte.com/collections/discontinued-closeouts.
Laserlyte, "UTA-DB Diamondback Laser", Rev Aug. 2013, 2 pages.
Diodes Incorporated, "PAM2804 1A Step Down Constant Current, High Efficiency LED Driver", Jan. 2013, 10 pages.
Microchip Technology, Inc., "PIC12F7525/HV752 Data Sheet, 8-Pin, Flash-Based 8-Bit CMOS Microcontrollers", ©2011, 210 pages.
Crimson Trace Corporation, "Crimson Trace CMR-202 Rail Master", Instruction Handbook, 27-1455 REV001 Apr. 2012, 2 pages.
European Patent Office, "European Search Report, EP Application No. 16150798", dated May 19, 2016, 8 pages.
Streamlight, Inc., "TLR-6 Subcompact Gun-Mounted Tactical Light With Integrated Red Aiming Laser", ©2016, 5 pages, www.streamlight.com.
Crimson Trace Corporation, "LTG-736 Lightguard for Glock Full-Size and Compact", ©2016, 3 pages, http://www.crimsontrace.com/.
Crimson Trace Corporation, "LG-452 Laserguard Green Laser Sight for Glock Full-Size and Compact", ©2016, 7 pages, http://www.crimsontrace.com/.
Crimson Trace Corporation, "DS-121 Defender Series Accuguard Laser Sight for Glock Full-Size and Compact", ©2016, 10 pages, http://www.crimsontrace.com/products/manufacturer/glock/015100.
Streamlight, Inc., "Light Mountable on a Handgun", Design U.S. Appl. No. 29/570,804, filed Jul. 12, 2016, 30 pages.
USPTO, "Notice of Allowance", Design U.S. Appl. No. 29/570,804, dated Jun. 23, 2017, 10 pages.
USPTO, "Notice of Allowance", U.S. Appl. No. 14/726,849, dated Jun. 8, 2017, 11 pages.
USPTO, "Office Action", U.S. Appl. No. 14/726,849, dated Nov. 28, 2016, 9 pages.

* cited by examiner

MODULAR LIGHT MOUNTABLE ON A HANDGUN

The present invention in one aspect relates to a light mountable on a firearm and, in particular, to a light mountable on a handgun.

Lights mountable on a firearm are available in many configurations. For lights mountable on a handgun e.g., a pistol, the selection of available lights is quite limited. An owner of several such firearms must have separate lights each of which is configured to mount to a particular handgun, and must choose between a light providing illumination, e.g., a beam of light for illuminating an area, and a light providing a laser spot beam for aiming the firearm.

This situation not only limits the type of light available to a firearm owner at any given time, but results in significant expense to acquire plural lights each mountable on a particular handgun and providing a particular kind of light.

In addition, presently known available handgun lights must be removed from the firearm, which requires a tool, in order to change the battery, which is both time consuming and inconvenient. For such lights that provide a laser spot beam or other aiming light, the alignment of the laser beam with the firearm sighting for accurately aiming the firearm is lost when the light is removed from and reinstalled on the firearm. Each of these conditions is a severe disadvantage, and for military and police handgun users, could increase risk to life and limb.

Applicant believes there may be a need for a light that is mountable on a handgun in an improved manner, e.g., by attaching to the handgun at more than one location thereof.

In addition, Applicant believes there may be a need for a light mountable on a handgun that can be mounted to different handguns without having to obtain an additional light for each type of handgun. It is also believed to be advantageous for a light for a handgun to provide both light for illumination and a laser spot beam for aiming.

Accordingly, a light mountable on a handgun may comprise: a light module including one or more light sources, a cavity for a source of electrical power, a switch, and a circuit for energizing the light sources; an outer light housing may have complementary housing parts enclosing the light module, and defining a cavity configured to receive a part of the handgun and a rail recess configured for receiving a mounting rail of the handgun, and an opening through which the electrical switch of the light module is actuatable. The outer light housing may include an access cover that is openable when the light is mounted on a handgun, for placing and removing the source of electrical power.

According to another aspect, a light mountable on a handgun may comprise: a light module including one or more light sources, a cavity for a source of electrical power, a switch, and a circuit for energizing the light sources; an outer light housing may have complementary housing parts enclosing the light module, and defining a cavity configured to receive a part of the handgun and a rail recess configured for receiving the mounting rail of the handgun, and an opening through which the electrical switch of the light module is actuatable.

A light mountable on a handgun may comprise: a light housing having first and second complementary housing parts that define a first cavity configured to correspond to a trigger guard of the handgun and to define a rail recess configured to correspond to a mounting rail of the handgun; the light housing includes an illumination light source or a laser aiming light source or both, at least one electrical switch, and a control circuit for selectively energizing the illumination light source, the laser aiming light source, or both; whereby the light is mountable to the trigger guard and mounting rail of the handgun. The light housing may have one or more openings through which light produced by the illumination and/or laser aiming light sources may be emitted. The light housing may have an opening through which the electrical switch is actuatable from outside the light housing.

According to yet another aspect, a light mountable on a handgun may comprise: a light module including an illumination light source and a laser aiming light source, an electrical switch, and a circuit for energizing the illumination light source and the laser aiming light source, and defining a cavity for a source of electrical power; an outer light housing enclosing the light module, and defining a cavity and a rail recess configured to correspond to a trigger guard and a mounting rail of the handgun. Further, the light may have an opening through which the electrical switch is actuatable from outside the outer light housing. Still further, the outer light housing may include an access cover on an exterior surface that is not adjacent the handgun that is openable when the light is mounted on a handgun for placing a source of electrical power into the light module housing and for removing the source of electrical power from the light module housing.

In summarizing the arrangements described and/or claimed herein, a selection of concepts and/or elements and/or steps that are described in the detailed description herein may be made or simplified. Any summary is not intended to identify key features, elements and/or steps, or essential features, elements and/or steps, relating to the claimed subject matter, and so are not intended to be limiting and should not be construed to be limiting of or defining of the scope and breadth of the claimed subject matter.

BRIEF DESCRIPTION OF THE DRAWING

The detailed description of the preferred embodiment(s) will be more easily and better understood when read in conjunction with the FIGURES of the Drawing which include.

Figure 1A:
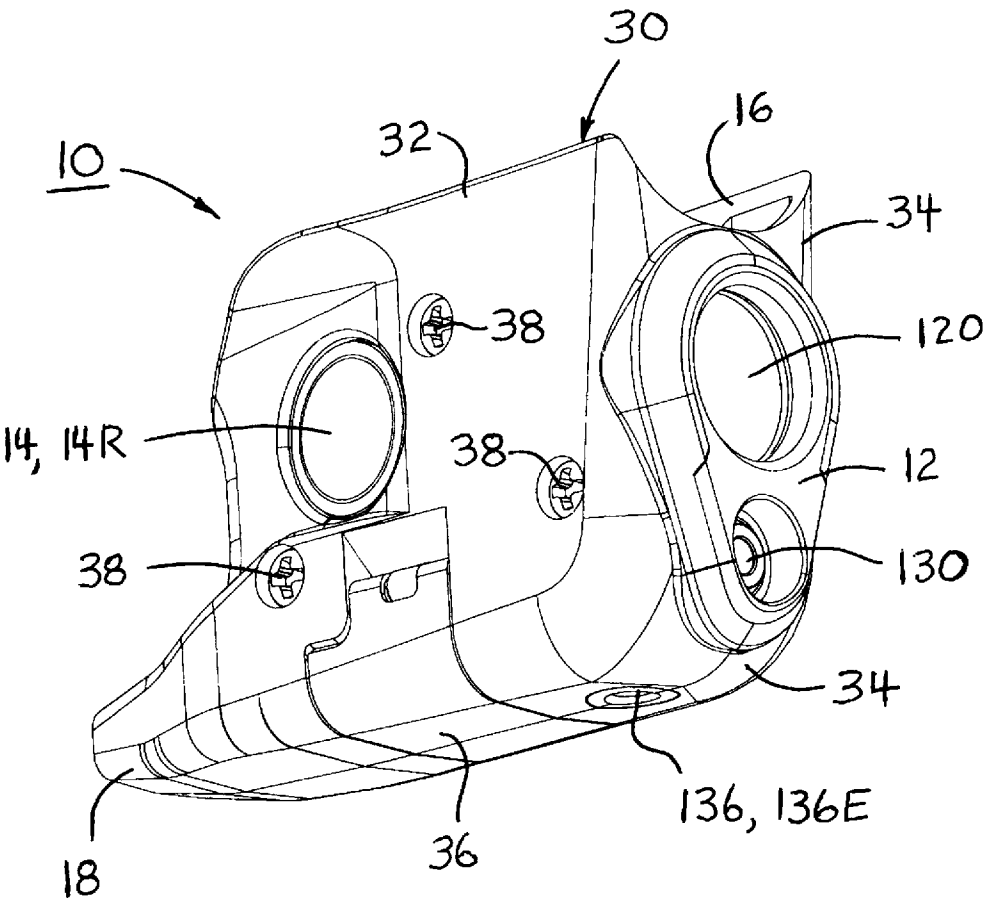
FIGS. 1A and 1B are perspective views of an example embodiment of a light mountable on a handgun.

In the Drawing, where an element or feature is shown in more than one drawing figure, the same alphanumeric designation may be used to designate such element or feature in each figure, and where a closely related or modified element is shown in a figure, the same alphanumerical designation may be primed or designated "a" or "b" or the like to designate the modified element or feature. Similar elements or features may be designated by like alphanumeric designations in different figures of the Drawing and with similar nomenclature in the specification. As is common, the various features of the drawing are not to scale, the dimensions of the various features may be arbitrarily expanded or reduced for clarity, and any value stated in any Figure is by way of example only.

DESCRIPTION OF THE PREFERRED EMBODIMENT(S)

Figure 1B:
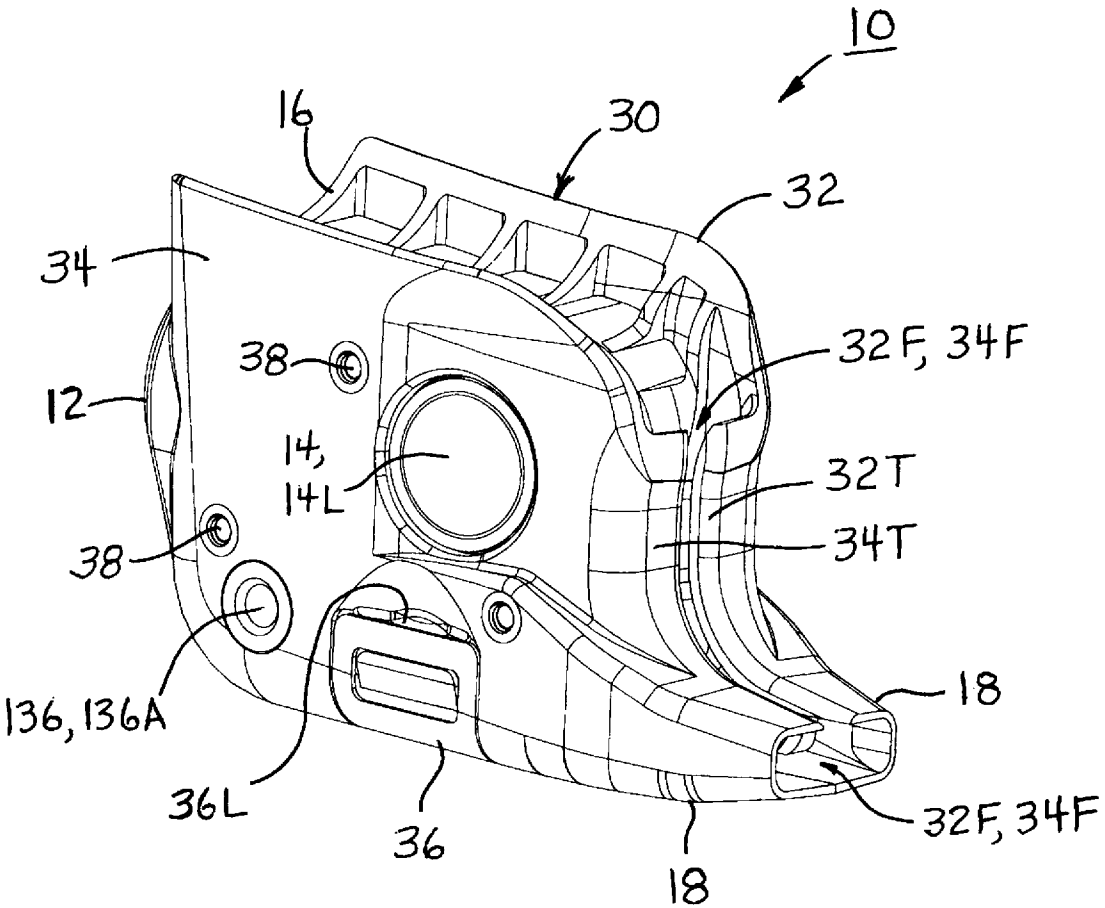
Figure 1C:
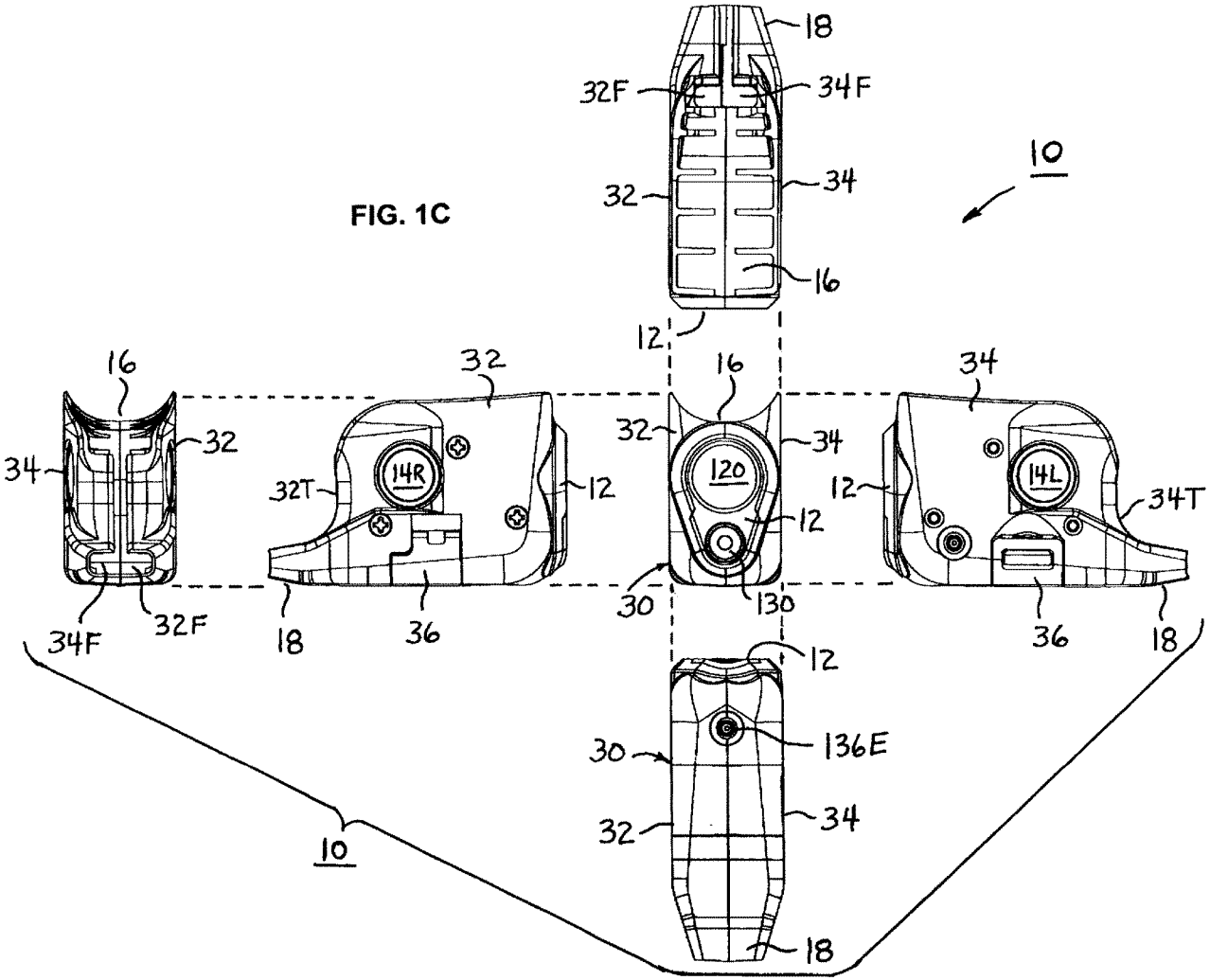
FIG. 1C shows six orthogonal views thereof.
Figure 2:
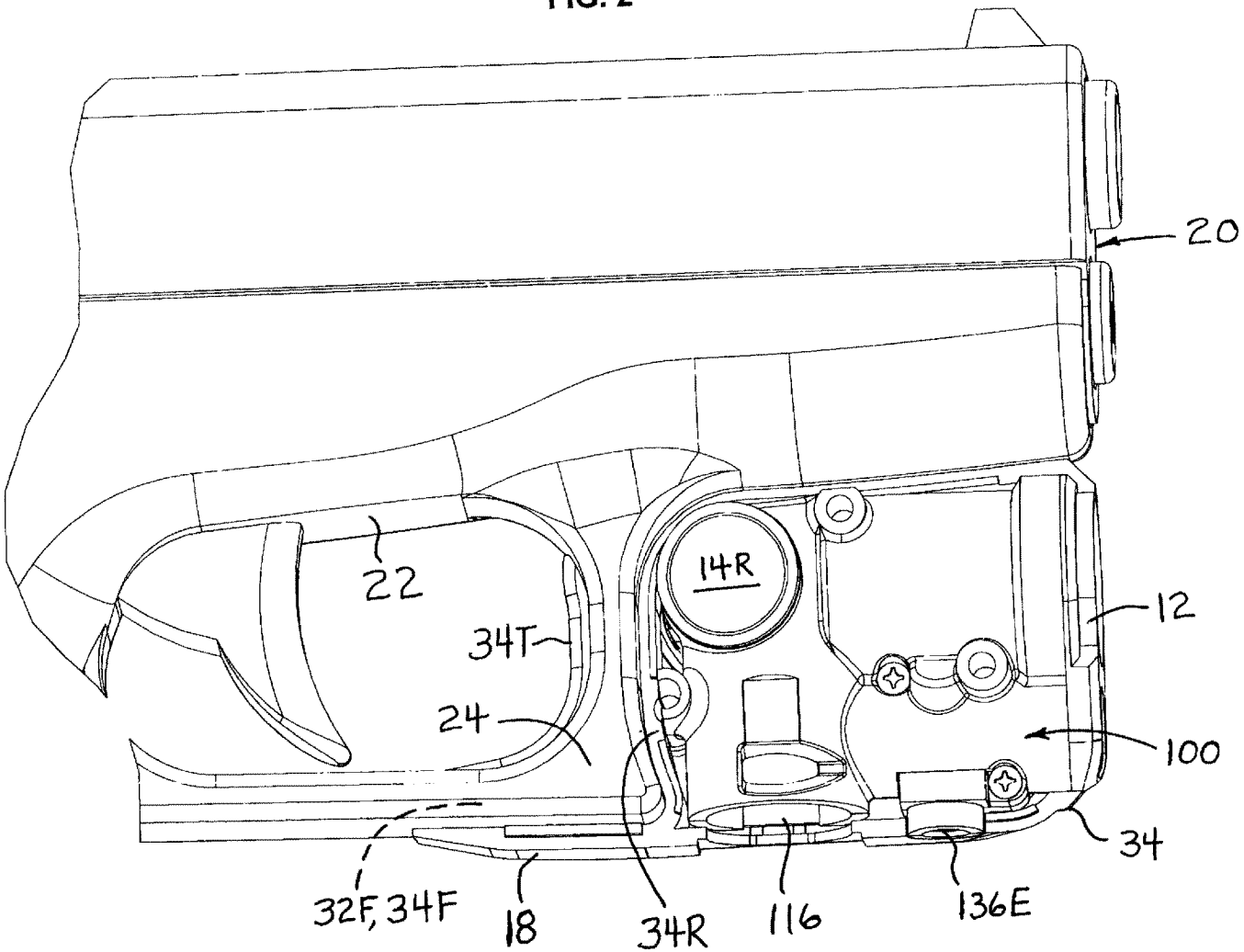
FIG. 2 is a side view of the example light of FIG. 1 with part of its housing removed to show a modular lighting device therein and to show the housing engaging the frame of a handgun.

FIGS. 1A and 1B are perspective views of an example embodiment of a light 10 mountable on a handgun 20, e.g., a pistol 20, viewed generally from the front and from the rear, and FIG. 1C which shows six orthogonal views thereof, and FIG. 2 is a side view of the example light 10 of FIG. 1 with part of its housing 30 removed to show a modular lighting device 100 therein and to show the outer housing 30 engaging the frame 22 of a handgun 20.

Example light 10 is intended to attach to a part of the frame 22 of a handgun 20, e.g., to a trigger guard 24 thereof by trigger guard extension 18, and to be positioned under the barrel 26 thereof, for which a generally barrel-shaped recess 16 is provided. While disposing the barrel of handgun 20 in barrel-shaped recess 16 may assist in stabilizing light 10 relative to handgun 20, it also provides a beneficial aesthetic look.

Light 10 provides light in a forward direction via a forward lens assembly 12, e.g., in a direction generally aligned with the trajectory of a projectile fired from handgun 20. Preferably, example light 10 provides light for illumination of an area, which is emitted by illumination light source 120, and provides light for aiming handgun 20, which is emitted by laser light source 130. In such instance, light source 120 provides a wider beam, e.g., a flood beam, and light source 130 provides a very narrow spot beam.

Light 10 includes at least one external actuator 14 by which either or both of light sources 120, 130 may be selectively energized to produce light. Because shooters may be right handed or left handed, actuator 14 preferably includes two actuators providing the same functionality: an actuator 14R on the right side of light 10 that can be actuated by a right finger of a shooter gripping handgun 20 with his right hand and an actuator 14L on the left side of light 10 that can be actuated by a left finger of a shooter gripping handgun 20 with his left hand. Preferably, while either of actuators 14R and 14L can be utilized independently to provide the full range of operating states of illumination light source 120 and of laser light source 130, it is also preferred that actuators 14R, 14L can also be utilized in combination to also provide the full range of operating states of light sources 120, 130.

In the modular configuration of light 10, a modular light source 100 that includes all of the operating elements of a light, e.g., a housing 110, one or more light sources 120, 130, a cavity for an electrical power source 150, and a switch 146 for actuating the one or more light sources 120, 130, is enclosed in an outer light housing 30, and so outer housing 30 provides an enclosure and support for light module 100 as well as support for the complete light 10 on handgun 20. Because the parts of light 10 that are most necessary for providing light and are also the most costly are contained in light module 100, that light module 100 can be configured to be a light 10 mountable on the frames of different handguns by merely replacing the outer light housing 30 with an outer housing 30 configured to be mounted to the frame of a different particular handgun.

Outer housing 30 includes first and second sides 32, 34, e.g., a right side 32 and a left side 34, that are complementary in shape so as to mate together and provide a complete enclosure for light module 100 and a frame cavity 32F, 34F which is configured to surround and clamp to a portion of the frame 22 of a handgun 20, e.g., around a trigger guard 24 thereof. The respective parts of outer housing sides 32, 34 that cooperate to provide trigger guard extension 18 cooperate to define a frame cavity that is formed by complementary frame cavities 32F, 34F of the right and left housing sides 32 and 34, respectively. The frame cavities 32F, 34F are respectively defined by the respective trigger guard extensions 18R, 18L of outer housing sides 32, 34 and by the respective backing members 32T, 34T thereof which are configured to complement and surround the frame 22, e.g., trigger guard 24, of a particular handgun 20.

In a pair of outer housing sides 32, 34 of a particular outer light housing 30, cavities 32F, 34F are configured to receive part of the frame 22, e.g., the trigger guard, of a particular handgun 20. Other pairs of outer housing sides 32, 34 of other particular light outer housings 30, define other cavities 32F, 34F that are configured to receive part of the frame 22, e.g., the trigger guard, of different particular handguns 20, thereby to facilitate the interchangeability of light module 100 from one handgun to another by merely changing the outer light housing 30.

Each side 32, 34 of outer light housing 30 has an actuator opening 32A, 34A through which access can be made to actuate switch 146, e.g., right and left side switches 146R, 146L of light module 100, and each of openings 32A, 34A is located on housing sides 32, 34 in a position adjacent to and aligned with switches 146R and 146L, respectively. Each of openings 32A, 34A may be covered with a flexible film or membrane or boot to reduce the entry of dirt, water and other unwanted foreign matter into outer light housing 30.

The interior surfaces of each side 32, 34 of outer light housing 30 preferably has an arrangement of ribs, posts and other projections that are configured to abut light module 100 for supporting light module 100 within outer housing 30 in a predetermined position and for providing structural strength therefor. The arrangements of ribs, posts and other projections associated with cavities 32F, 34F that are configured to receive part of the frame 22, e.g., the trigger guard, are configured to abut the part of the frame 22 to which light 10 is mounted so as to clamp light 10 to the part of the frame 22 sufficiently tightly to securely mount light 10 in a desired position relative to handgun 20.

Installing and/or removing example light 10 from a handgun 20 simply involves removing the fasteners 38 that secure the sides 32, 34 of outer light housing together and light module 100 therein, placing (or removing) the sides 32, 34 with light module 100 therein in their respective positions relative to frame 22 of handgun 20, and replacing and tightening fasteners 38 to secure light 10 in position on frame 22 of handgun 20.

Figure 3A:
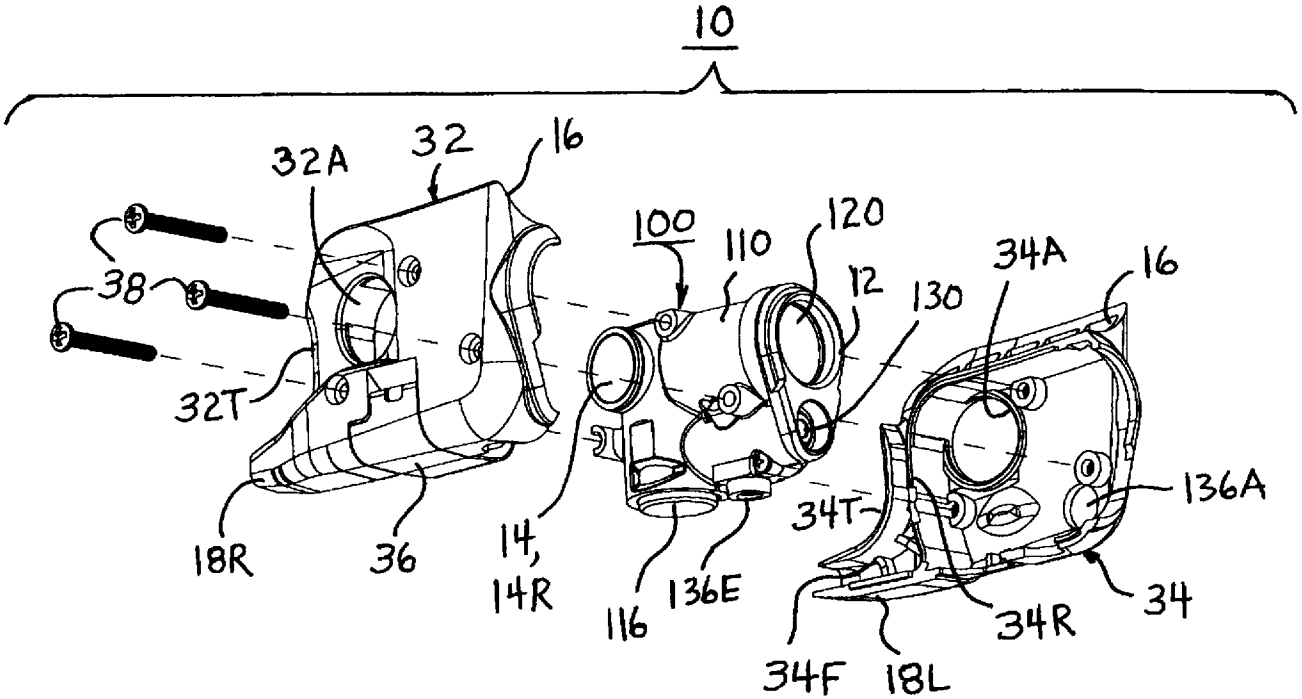
FIG. 3A is an exploded view of the example light of FIGS. 1 and 2 with light module therein.
Figure 3B:
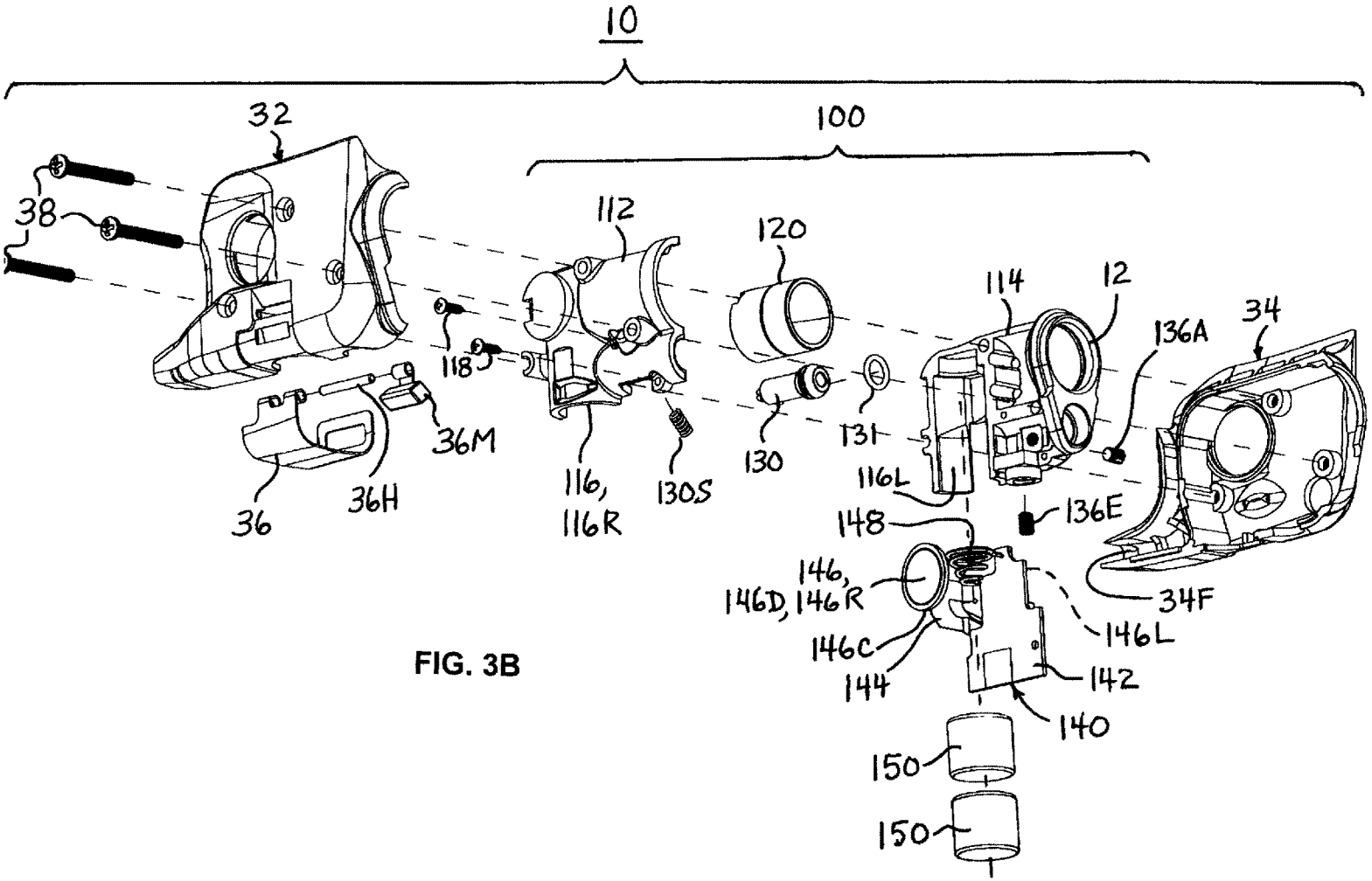
FIG. 3B is an exploded view of the example light and of the example light module.
Figure 4A:
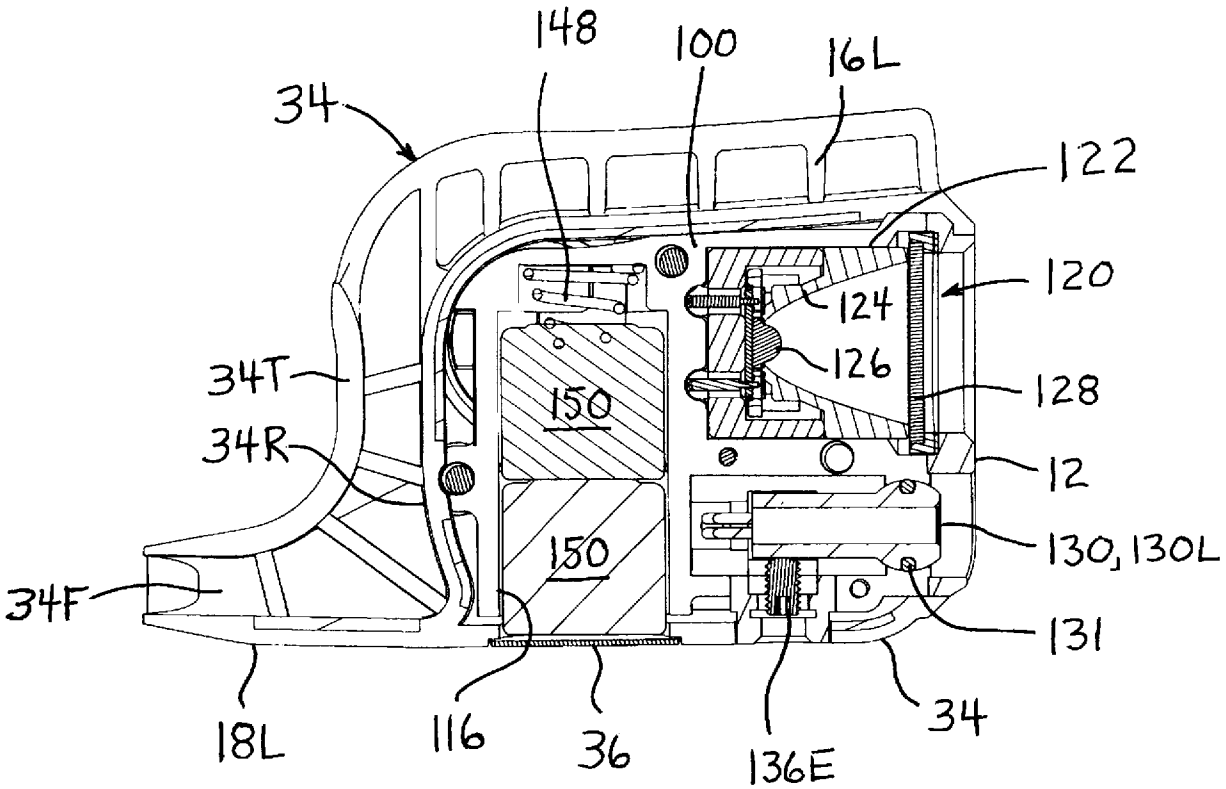
FIG. 4A is a longitudinal cross-sectional view and FIGS. 4B and 4C are different transverse cross-sectional views of the example light and example light module of FIGS. 1-3.
Figure 4B:
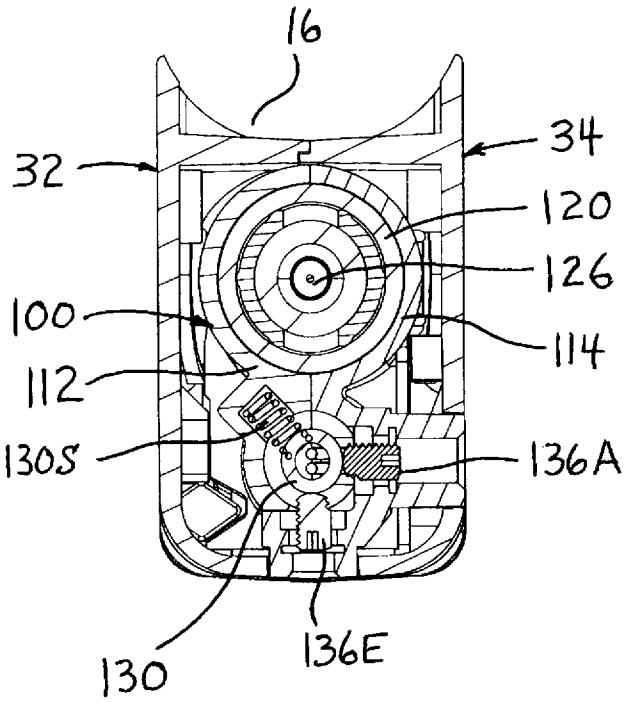
Figure 4C:
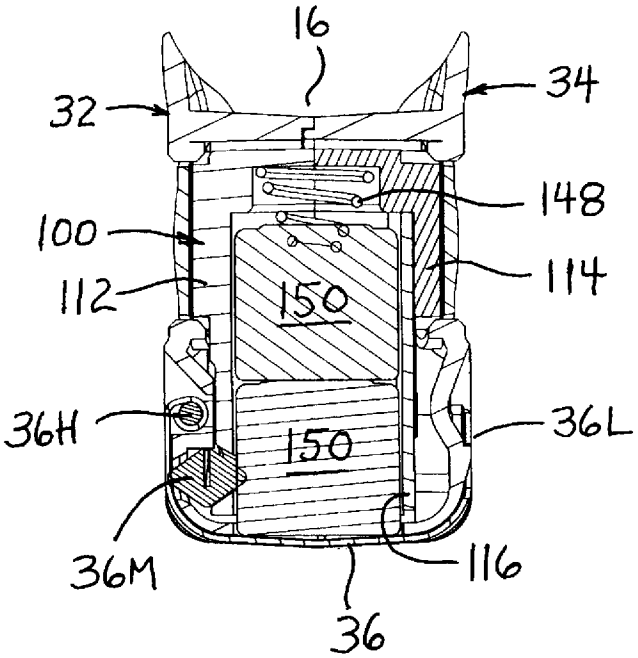

FIG. 3A is an exploded view of the example light 10 of FIGS. 1 and 2 with light module 100 therein, and FIG. 3B which is an exploded view of the example light 10 and of the example light module 100; and FIG. 4 includes FIG. 4A which is a longitudinal cross-sectional view of the example light 10 and example module 100 of FIGS. 1-3, and FIGS. 4B and 4C which are different transverse cross-sectional views of the example light 10 and example module 100 of FIGS. 1-3.

Outer light housing 30 sides 32, 34 are seen to fit together similar to a clamshell to surround and enclose light module 100 therein and to have rims formed to receive forward lens assembly 12 in the forward ends thereof and to define the frame cavity 32F, 34F near the rearward end thereof. The rearward portions 32R, 34R of the rim of sides 32, 34 cooperate with each other and with backing members 32T, 34T and trigger guard extensions 18R, 18L to define frame cavity 32F, 34F into which a part of frame 22 of handgun 20, e.g., trigger guard 24 thereof, is received for attaching light 10 to handgun 20. One or more fasteners 38 retain outer housing sides 32, 34 together and light 10 on handgun 20.

Light module 100 is seen to have a housing 110 including housing sides 112, 114 that fit together and are retained together by one or more fasteners 118. Light module housing 110 preferably encloses light sources 120, 130 and circuit structure 140 therein, and provides a cavity 116 for receiving one or more batteries 150 therein. Light module 100 provides a forward lens assembly 12 at the forward end of housing 110 thereof and actuators 14R, 14L on opposing sides thereof in locations to be adjacent to the respective actuator openings 32A, 34A of outer light housing 30. Forward lens assembly 12 may have respective openings for light sources 120, 130, and a lens may be provided at lens assembly 12 and/or as part of light sources 120, 130.

Illumination light source 120 preferably includes an outer housing 122, a reflector 124, e.g., defined by the interior shape of outer housing 122, a light emitting diode (LED) light source 126, typically a while LED, for providing an illumination light beam, e.g., typically a relatively wide or flood beam of light, e.g., a beam having a beam width of about 10° to 150° or more. A lens 128 is provided at the forward end of housing 122 and reflector 124 through which light produced by LED 126 passes.

Laser light source 130 includes a laser diode and lenses to provide a very narrow beam of coherent light, e.g., a laser beam having a divergence of only about ±2°. A lens 130L may be provided as part of laser cartridge 130 or separately between laser cartridge 130 and lens assembly 12. Because laser light source 130 is intended to be used for aiming the handgun 20 to which light 10 is attached, the alignment of the laser light beam produced thereby and the bore sight of handgun 20 are preferably brought into alignment to be coincident so that the target illuminated by the laser beam will be the target hit by a projectile launched from the handgun.

To this end, laser light cartridge 130 is movably supported in a cavity of light module housing 110, e.g., with its forward end bearing against an O-ring 131, or grommet, ball joint or other joint 131, with respect to which cartridge 130 may pivot over a range of angles, wherein its longitudinal axis is movable, e.g., is pivotable or rotatable, in both azimuth and elevation relative to light 10 (and handgun 20 to which light 10 is mounted). In one example embodiment, laser cartridge 130 is rotatable over about ±5° relative to the housings 110, 30 of module 100 and of light 10.

Azimuth adjustment 136A may include a screw 136A that is threaded into a horizontal hole in housing side 114 to bear against the side of laser cartridge 130 so that by rotating adjustment screw 136A in one direction or the other, laser cartridge 130 may be moved, e.g., pivoted, to the right or to the left to adjust the azimuth direction of the laser light beam produced by laser cartridge 130. Similarly, elevation adjustment 136E may include a screw 136E that is threaded into a vertical hole in housing side 114 to bear against the underside of laser cartridge 130 so that by rotating adjustment screw 136E in one direction or the other, laser cartridge 130 may be moved, e.g., pivoted, upward or downward to adjust the elevation direction of the laser light beam produced by laser cartridge 130. Biasing spring 130S is positioned at an about 45° angle to urge laser cartridge 130 against both adjustment screws 136A and 136E so that the position and alignment of laser cartridge 130 is maintained in the position to which it is adjusted by adjustment screws 136A, 136E.

One or more batteries 150 may be disposed in battery cavity 116 of light module 100 which is defined by right and left portions 116R, 116L of module housing sides 112, 114. Electrical connection to a battery terminal at the upper end of batteries 150 may be provided by an electrical contact 148, e.g., a helical or conical spring 148, of circuit structure 140 and electrical connection to a battery terminal at the lower end of batteries 150 may be facilitated and/or provided by battery cover 36 of outer light housing 30.

Battery access cover 36 is hinged 36H to, e.g., right housing side 32, by, e.g., a hinge pin 36H and has a formed recess or projection 36L at the opposite end thereof which engages a corresponding projection or recess on the outer surface of left housing side 34 thereby to latch and retain battery access cover 36 in its closed position, thereby to retain batteries 150 in light 10, and to unlatch so that batteries 150 may be removed and/or replaced. Preferably, access cover snaps on when pressed closed and can be snapped off to be opened, e.g., using a finger or a coin, without the need for a tool. An advantage to this arrangement is that the batteries 150 may easily and conveniently be replaced without having to remove light 10 from the handgun 20, and preferably without the need for a tool.

A movable member 36M is provided adjacent to battery cover 36 so that it is positioned between battery and in physical contact with battery cover 36 and lower battery 150 when battery cover 36 is closed, but is free to move outwardly, e.g., away from battery cavity 116, when battery cover 36 is open. Member 36M is urged by battery cover 36 to bear, e.g., laterally, against the side of lower battery 150, to which side electrical connection to battery 150 may be made, thereby to bias and preferably press the side of lower battery 150 against circuit structure 140, e.g., against circuit board 142 thereof, for making electrical contact with an electrical conductor thereon.

Thus, battery 150 is biased laterally by movable member 36M to be in electrical contact with circuit board 142 and the circuitry thereon, thereby to complete the connections of batteries 150 in the circuitry of light 10. In one example embodiment, movable member 36M includes a loop through which hinge pin 36H passes so that battery cover 36 and member 36M are both pivotable about hinge pin 36H for providing the desired urging and biasing of lower battery 150 against circuit board 142.

Circuit structure 140 is positioned in module housing 110 rearward of light sources 120, 130 proximate battery cavity 116. A main circuit board 142 includes control circuitry for operating light sources 120, 130 and the left side electrical switch 146L in proper position so as to be adjacent to actuator opening 34A of left outer housing side 34. Circuit board 142 supports an extender circuit board 144, e.g., generally perpendicular thereto. Circuit board 144 provides electrical connection to switch circuit board 146C which supports right side electrical switch 146R in proper position so as to be adjacent to actuator opening 32A of right outer housing side 32, and may also include a portion of the control circuitry.

Each of electrical switches 146 preferably includes a metal dome switch element 136D that is adjacent to an electrical conductor pattern on circuit board 142 or 146 to which it makes electrical contact when depressed, e.g., via actuator openings 14R, 14L of outer housing 30. Typically, a flexible cover or boot is provided over each metal dome switch element, e.g., to retain it in position relative to circuit board 142 or 146. Circuit board 142 preferably supports one or more electrical contacts 148, which preferably include one or more helical electrically conductive springs for making electrical connection to a battery 150 in the battery cavity 116 of the light module 100.

Figure 5:
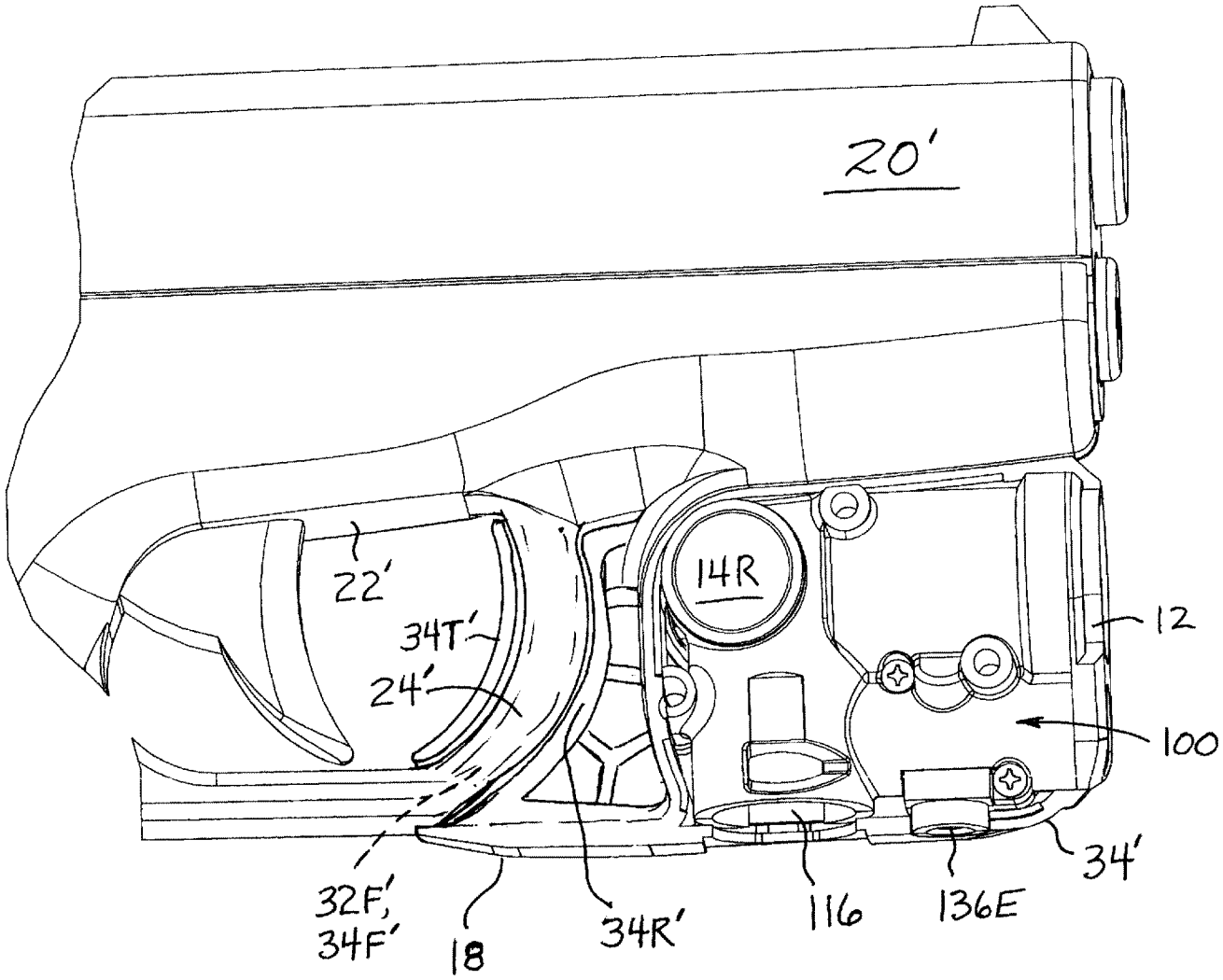
FIG. 5 is a side view of the interior side of one part of the outer light housing for use with a different handgun than is the light of FIGS. 1 and 2.

FIG. 5 is a view of the interior side of one part, e.g., left side 34', of an example outer light housing 30' for use with a different handgun 20' than is the housing 30 of light 10 of FIGS. 1 and 2. The particular example outer light housings 30 and 30' differ only in the shape and size of the cavity 32F, 34F and 32F', 34F' that are configured to correspond to the size and shape of a part of the frame 22 of the handgun 20, 20', e.g., the respective trigger guards 24, 24' thereof.

Both of sides 34, 34' are configured identically for receiving and supporting light module 100 therein and for being attached together by fasteners 38. They differ only with respect to their barrel-shaped recesses 16, 16' and their respective frame cavities 34, 34' because each barrel-shaped recess 16, 16' and each frame cavity 34, 34' is configured for receiving a particular part of a particular handgun, e.g., a particular barrel shape and part of a particular frame 22, 22' thereof.

As can be seen in, e.g., FIG. 2, the frame cavity 32F, 34F into which trigger guard 24 of frame 22 fits, are defined respectively by backing member 32T and rearward portion 32R of right housing side 32 of housings 32, and by backing member 34T and rearward portion 34R of housing 34, respectively. Frame cavity 32F, 34F is substantially wider at the transition thereof between the portion receiving the bottom horizontal part of trigger guard 24 and the portion thereof receiving the forward vertical part of trigger guard 24, so as to conform to the shape of trigger guard 24 which has a curved forward part and a forward projection at the bottom thereof.

In comparison, as can be seen in FIG. 5, frame cavity 32F', 34F' thereof is substantially uniform in width and is curved so as to conform to the size and shape of the curved part of trigger guard 24'. Backing member 34T' and rearward member 34R' of housing side 34' in this embodiment have a curvature and shape to define a frame cavity 32F', 34F' that corresponds to the size and shape of the portion of frame 22' of handgun 20', e.g., the trigger guard 24' thereof, so as to firmly retain trigger guard 24' therebetween in frame cavity 32F', 34F'. Corresponding parts 32T', 32T' of housing side 32' are substantially a mirror image of those illustrated in FIG. 5 regarding housing side 34'.

Figure 6C:
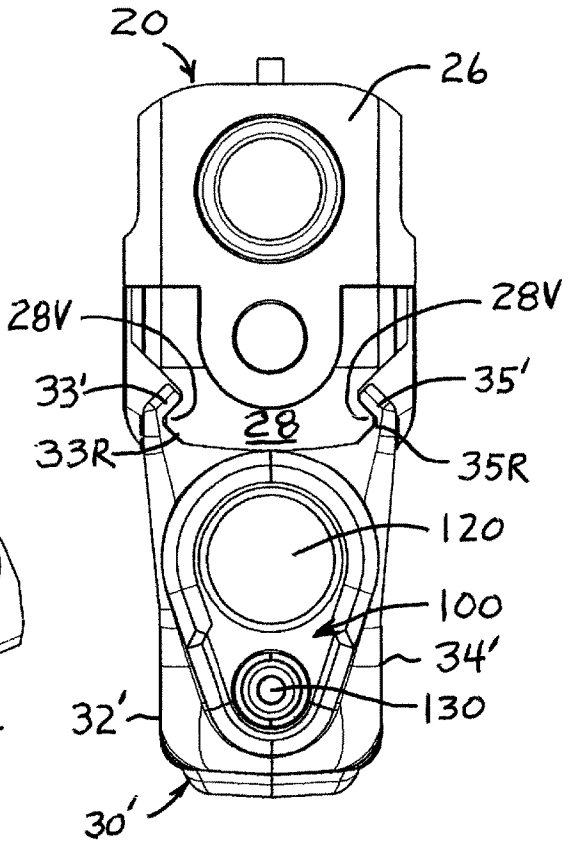
FIG. 6C is a frontal view of the forward end thereof.
Figure 6A:
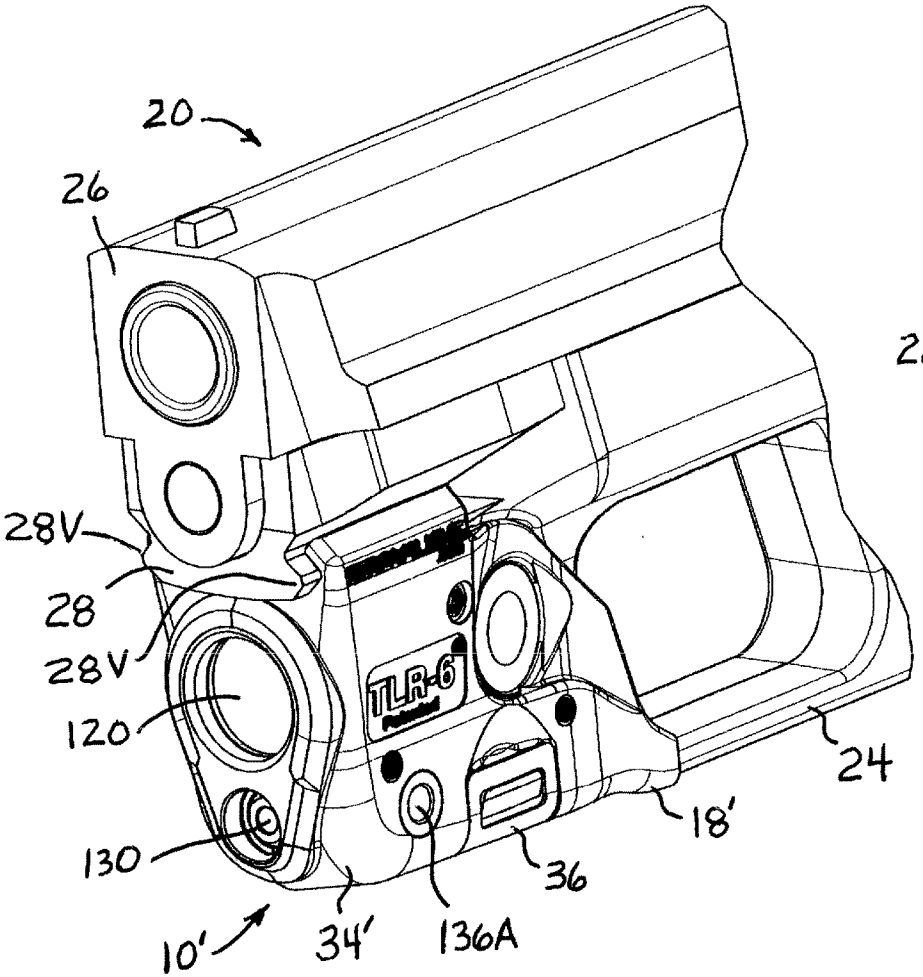
FIG. 6A is a perspective view of an example embodiment of a mountable light shown mounted on an example handgun.
Figure 6B:
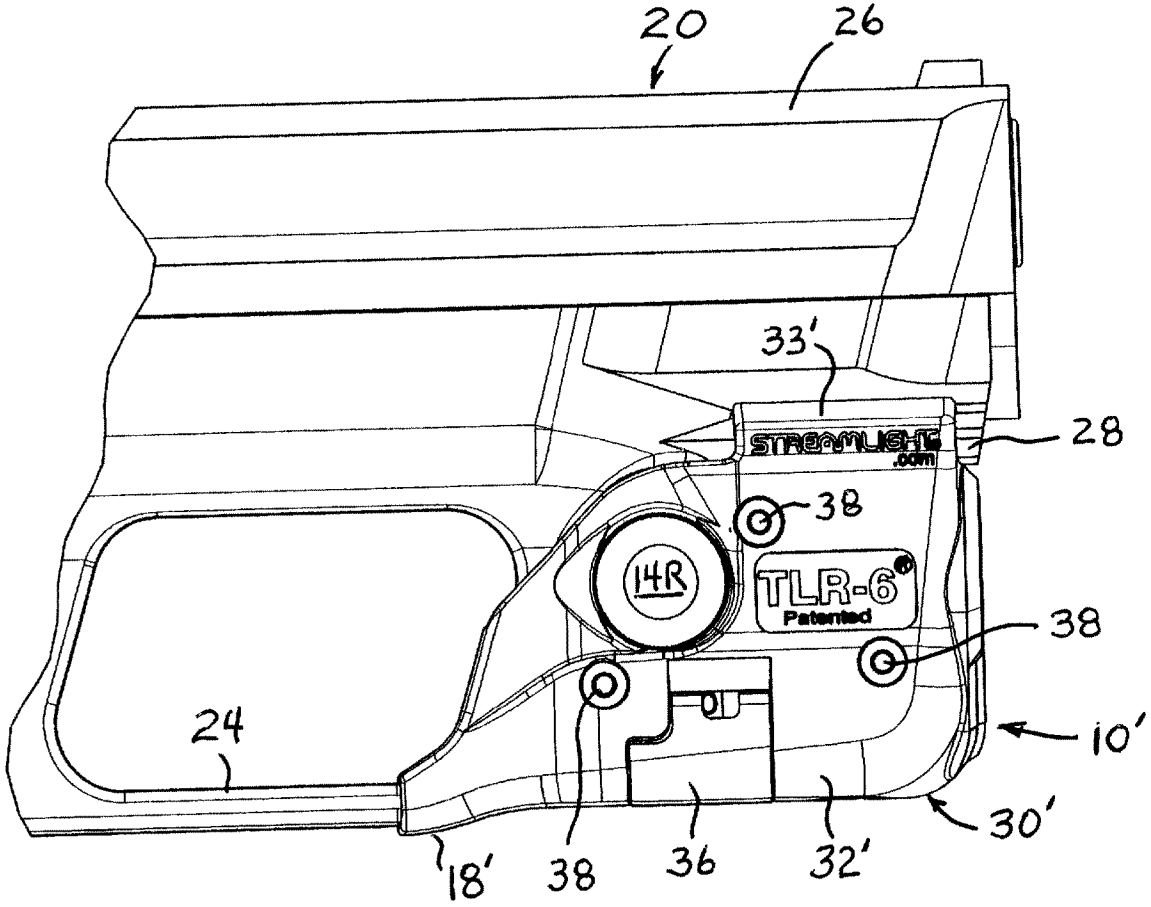
FIG. 6B is a side view thereof.
Figure 7A:
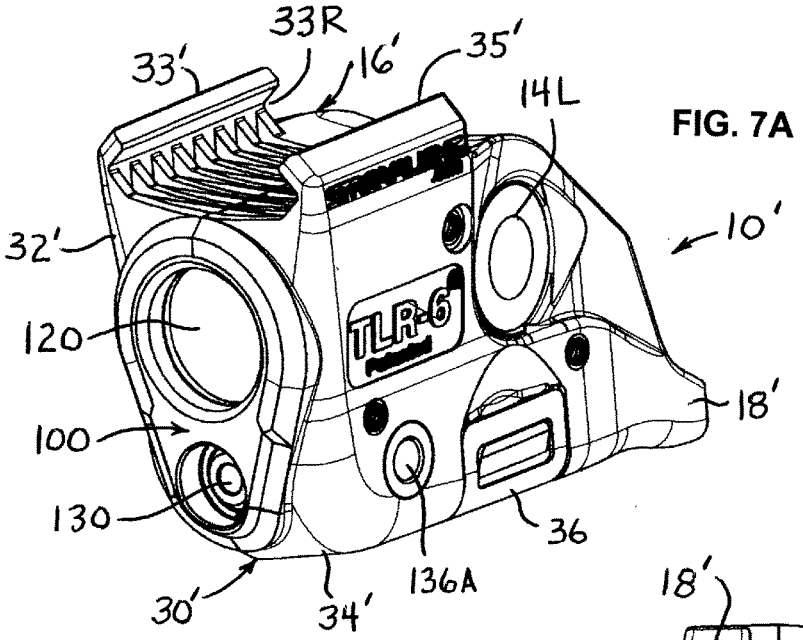
FIG. 7A is a perspective view of the example embodiment of a light mountable on a handgun of FIGS. 6A-6C.
Figure 7B:
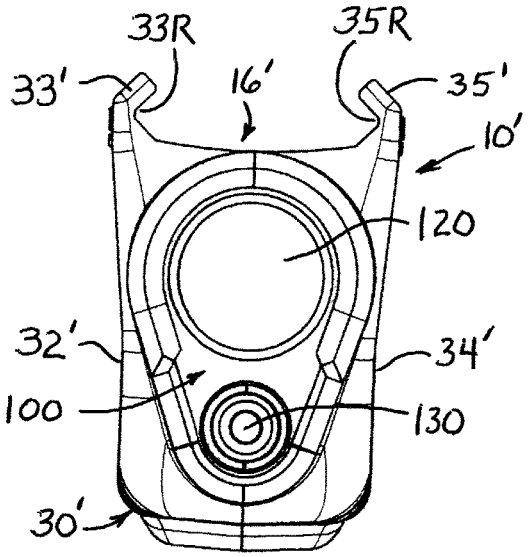
FIG. 7B is a frontal view of the forward end thereof.
Figure 7C:
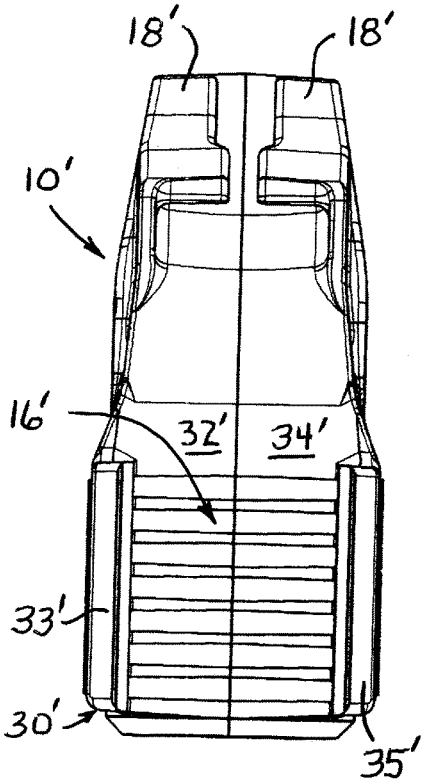
FIG. 7C is a view of the top side thereof.

FIG. 6A is a perspective view of an example embodiment of a mountable light 10' shown mounted on an example firearm 20, e.g., handgun 20, FIG. 6B is a side view thereof, and FIG. 6C is a frontal view of the forward end thereof; and FIG. 7A is a perspective view of the example embodiment of a light 10' mountable on a handgun 20 of FIGS. 6A-6C, FIG. 7B is a frontal view of the forward end thereof, and FIG. 7C is a view of the top side thereof. Light 10' has an outer housing 30' comprising two complementary outer housing parts 32', 34', e.g., a right side 32' and a left side 34', inside of which are the operating elements of light 10', e.g., light sources 120, 130. Operative elements 120, 130 and other operating elements of light 10' are preferably disposed in a module 100, enclosed by outer housing 30', all substantially as described above in relation to light 10 and outer housing 30.

Handgun 20, typically includes a frame 22 including a trigger guard 24 to which light 10' clamps when outer housing parts 32', 34' are attached to each other with the frame 22 and/or trigger guard 24 therebetween, as above. Handgun 20, may also include a mounting rail 28 which may be part of or attached at the underside of barrel 26 for having an accessory, e.g., a light, such as a mountable light 10', or a camera, mounted thereto.

Mounting rail 28 may be removable from handgun 20 or may be permanently part thereof, and rail 28 may be a standard rail, e.g., a Picatinny rail or a Springfield rail, or may be a custom rail, e.g., from a particular gun manufacturer such as Glock, Smith & Wesson, Sig Sauer, or other source. Mounting rails 28 typically have opposing longitudinal sides 28V that are shaped, e.g., in an outwardly extending V-shape, for reliably being gripped, e.g., by an accessory, such as light 10', having opposing sides of a shape complementary to that of rail 28, e.g., in an inward recess 33R, 35R such as an inwardly extending V-shape 33R, 35R.

Outer housing 30' defines an extension 18' extending rearward that clamps to a part of the frame 22 of handgun 20, e.g., to a trigger guard 24 thereof, substantially as above. Outer housing 30' also defines a recess 16' for fitting light 10' adjacent to the bottom of the barrel 26 of handgun 20. Recess 16' may be shaped to receive a barrel 26, as above, and/or may be a recess 16' shaped to receive a mounting rail 28 and may be adjacent to or spaced away from barrel 26.

Recess 16' is defined by the shape of the respective upper portions 33', 35' of outer housing sides 32', 34', each of which typically is formed in the example embodiment to extend inwardly at an angle along its upper edge so as to define respective inwardly directed flanges 33', 35' that define respective rail recesses 33R, 35R of a shape and size complementary to the opposing longitudinal sides 28V of rail 28 so that housing 30' of light 10' is configured to fit onto mounting rail 28 and to be clamped thereto. As above for housing 30, housing 30' may have a plurality of transverse ribs on its upper surface adjacent recess 16 which may strengthen the upper portions of housing sides 32', 34'.

Light 10' is mounted to a firearm 20 by placing module 100 inside one of housing sides 32', 34' and placing firearm 20 onto one housing side 32', 34' with its trigger guard 24 in the trigger guard cavity 32F, 34F thereof and its rail 28 in the rail recess 33R, 35R thereof. Then the other housing side 32', 34' is placed adjacent firearm 20 with trigger guard 24 in its trigger guard cavity 32F, 34F and its rail recess 33', 35R adjacent rail 28. Light 10' is secured in this position relative to firearm 20 by tightening fasteners 38 to fasten the two housing sides 32', 34' to each other with the trigger guard 24 and rail 28 clamped therebetween. Mountable light 10' is thereby securely mounted to handgun 20 which may be bore sighted to adjust the azimuth 136A and elevation 136E of laser aiming light source 130, as described above.

It is noted that the right and left sides 32', 34' of outer housing 30' of light 10' clamp onto handgun 20 at two spaced apart locations, e.g., extension 18' clamps onto trigger guard 24 and rail recesses 33R, 35R clamp onto rail 28, thereby providing a very stable attachment of light 10' to handgun 20. Not only are the two mounting locations spaced apart, but they tend to be at different angles, e.g., with the rail 28 being substantially horizontal in the usual aiming orientation and at least part of the trigger guard 24 being substantially vertical therein.

Light 10, 10' clamping to trigger guard 24 provides a stable mounting, e.g., because the trigger guard typically has a part that is substantially horizontal and a part that is substantially vertical, but those parts of the trigger guard are usually close to each other both being part of the same trigger guard. Thus, the clamping action of present light 10, 10' which clamps to two spatially separated and substantially orthogonal parts, or at least to two parts that are at a substantial angle with respect to each other, of handgun 20 is viewed as providing an improved mounting stability.

Thus, once light 10, 10' is mounted to handgun 20, the laser aiming light source 130 can be bore-sighted in azimuth and elevation and will retain those settings until light 10, 10' is removed from handgun 20. This stability of these laser 130 aiming settings can be maintained because the battery for light 10, 10' may be accessed and replaced via battery access cover 36 without removing light 10, 10' from handgun 20, as described above. Battery access cover 36 is preferably attached to housing 30' so that it cannot become separated and cannot be easily misplaced or lost, also as above.

Light 10' is thought to provide an even more stable mounting to handgun 20 because the trigger guard 24 and mounting rail 28 are spaced apart by a relatively greater distance than are the parts of trigger guard 24. In addition, clamping to trigger guard 24 and to mounting rail 28 tend to define a Z shape of parts to which light 10' attaches, including that the longitudinal sides 28L of mounting rail 28 are in a plane that is substantially orthogonal to the plane of trigger guard 24, thereby to provide improved stability.

In a typical embodiment, housings 30, 30' and 110 are of any suitable plastic or metal material, e.g., preferably a molded plastic such as a nylon, engineered nylon, polycarbonate, polyethylene, a PC/PET plastic blend, ABS plastic, with or without a reinforcing material such as a fiberglass, carbon fiber or the like, or any other suitable plastic or other moldable material. Outer housing 30, 30' in particular, or parts thereof, e.g., battery cover 36, may be made from an aluminum, brass, beryllium copper, stainless steel, or other metal, e.g., where the strength and/or electrical conductivity provided thereby, and/or the lack thereof, is considered necessary or desirable. Movable member 36H may be of one of the foregoing plastic materials or of a resilient polymer, elastomer or other plastic material, e.g., a urethane, silicone, rubber, synthetic rubber, or the like, and may be overmolded onto a loop of a metal or other suitable material. By way of further example, some or all of the inner surfaces of housing sides 32, 34, 32', 34' that define frame cavity 32F, 34F may be of one of the foregoing polymer, elastomer or other resilient plastic materials, thereby to increase friction between frame 22 of handgun 20 and housing 30, 30' of light 10, 10' for better retaining light 10, 10' in a desired position relative to handgun 20.

In one typical embodiment, light 10, 10' is about 2.3 inches (about 5.8 cm) in length, about 0.85 inches (about 2.2 cm) in width, and about 1.5 inches (about 3.8 cm) in height, and light module 100 is about 1.5 inches (about 3.8 cm) in length, about 0.8 inches (about 2.0 cm) in width, and about 1.2 inches (about 3.0 cm) in height.

In one example embodiment of lighting circuit 200, microprocessor U1 is a type PIC12F752 device which is an 8-bit micro-controller that is commercially available from Microchip Technology, Inc. located in Chandler, Ariz., and DC converter U2 is a type PAM2804 device which is a step down LED driver that is commercially available from Diodes Incorporated located in Dallas (Plano), Tex.

Other examples of electrical and/or control circuitry suitable for use in an example embodiment of a light 10, 10' are described, e.g., in U.S. Pat. No. 7,466,082 entitled "ELECTRONIC CIRCUIT REDUCING AND BOOSTING VOLTAGE FOR CONTROLLING LED CURRENT," in U.S. Pat. No. 8,662,701 entitled "FLASHLIGHT HAVING A CONTROLLER PROVIDING PROGRAMMABLE OPERATING STATES," in U.S. Pat. No. 8,258,416 entitled "ELECTRICAL SWITCH AND FLASHLIGHT," and in U.S. Pat. No. 8,779,683 entitled "LIGHT HAVING A CIRCUIT ACCOMMODATING BATTERIES OF DIFFERENT TYPES AND/OR SIZES," each of which is assigned to Streamlight, Incorporated, located in Eagleville, Pa., and is hereby incorporated herein by reference in its entirety, for any purpose.

A light 10,10' mountable on a handgun 20 may comprise: a light module 100 including a light module housing 110 supporting one or more light sources 120, 130, at least one electrical switch 146, and a control circuit for selectively energizing the one or more light sources 120, 130, and defining a cavity for receiving a source of electrical power 150; an outer light housing 30, 30' having first and second complementary housing parts 32, 34, 32', 34' enclosing the light module 100, the first and second complementary housing parts 32, 34, 32', 34' cooperating when together to define at a first end of the outer light housing 30, 30' a second cavity 32F, 34F configured to correspond to the size and shape of a first part of the handgun and to define at an upper part of the outer light housing 30, 30' a rail recess 16', 33R, 35R configured to correspond in size and shape to a mounting rail of the handgun; whereby the light 10,10' is mountable to the handgun when the first and second complementary housing parts 32, 34, 32', 34' of the outer light housing 30, 30' are attached together with the part of the handgun in the second cavity 32F, 34F thereof and with the mounting rail of the handgun in the rail recess 16', 33R, 35R thereof; the outer light housing 30, 30' having one or more openings at a second end thereof through which light produced by the one or more light sources 120, 130 may be emitted; the outer light housing 30, 30' having an opening through which the at least one electrical switch 146 of the light module 100 is actuatable from outside the outer light housing 30, 30'. The outer light housing 30, 30' may include an access cover 36 on an exterior surface thereof that is not adjacent the handgun, the access cover 36 being openable when the light 10,10' is mounted on a handgun for placing a source of electrical power 150 into the light module housing 110 and for removing the source of electrical power 150 from the light module housing 110. The one or more light sources 120, 130 of the light module 100 may include: an illumination light source 120, or a laser aiming light source 130; or an illumination light source 120 and a laser aiming light source 130. The first and second complementary housing parts 32, 34, 32', 34' of the outer light housing 30, 30' may be attached together by one or more threaded fasteners 38, wherein tightening the one or more threaded fasteners 38 clamps the part of the handgun in the cavity therefor defined by the first and second complementary housing parts 32, 34, 32', 34' and clamps the mounting rail of the handgun in the rail recess therefor defined by the first and second complementary housing parts 32, 34, 32', 34'. The part of the handgun for which the cavity of the outer light housing 30, 30' is configured may include a trigger guard 24. The access cover 36 may be closable to retain the source of electrical power 150 in the light module housing 110; or the access cover 36 may be pivotably attached to one of the first and second complementary housing parts 32, 34, 32', 34' of the outer light housing 30, 30; or the access cover 36 may be closable to retain the source of electrical power 150 in the light module housing 110 and may be pivotably attached to one of the first and second complementary housing parts 32, 34, 32', 34' of the outer light housing 30, 30'. The light 10,10' mountable on a handgun may further comprise a movable member 36M disposed between the access cover 36 and a side of the source of electrical power 150, wherein the movable member 36M biases the source of electrical power 150 against a surface of the light module 100. The movable member 36M may bias the source of electrical power 150 against an electrical contact of the light module 100 so that the side of the source of electrical power 150 makes an electrical connection to the electrical contact, e.g., of a circuit structure. The light 10,10' mountable on a handgun may be in combination with at least a second outer light housing 30, 30' having first and second complementary housing parts 32', 34' for enclosing the light module 100, the first and second complementary housing parts 32', 34' of the second outer light housing 30, 30' cooperating when together to define at a first end of the outer light housing 30, 30' a cavity configured to correspond to the size and shape of a part of a different handgun than does the outer light housing 30, 30' and to define at an upper end or part thereof a rail recess configured to correspond to a mounting rail of the different handgun. The light module 100 may include an azimuth adjusting screw 136A and an elevation adjusting screw 136E for aiming the laser light source 130 in azimuth and elevation, respectively, and the outer light housing 30, 30' may have one or more openings 136 through which the azimuth adjusting screw 136A and the elevation adjusting screw 136E can be adjusted. Each of the first and second complementary housing parts 32, 34, 32', 34' may have an inwardly directed flange 33', 35' at the upper end or part thereof, the respective inwardly directed flanges 33', 35' of the first and second complementary housing parts 32, 34, 32', 34' cooperate to define at the upper part of the outer light housing 30, 30' the rail recess 16', 33R, 35R configured to correspond in size and shape to the mounting rail of the handgun.

A light 10,10' mountable on a handgun 20 may comprise: a light module 100 including in a light module housing 110: an illumination light source 120 and a laser aiming light source 130, at least one electrical switch 146, and a control circuit for selectively energizing the illumination light source 120 and the laser aiming light source 130, the light module housing defining a first cavity for receiving a source of electrical power 150, an outer light housing 30, 30' having first and second complementary housing parts 32, 34, 32', 34' enclosing the light module 100, the first and second complementary housing parts 32, 34, 32', 34' cooperating when together to define at a first end of the outer light housing 30, 30' a second cavity 32F, 34F configured to correspond to the size and shape of a trigger guard of the handgun and to define at an upper part of the outer light housing a rail recess 16', 33R, 35R configured to correspond in size and shape to a mounting rail of the handgun; whereby the light 10,10' is mountable to the part of the handgun when the first and second complementary housing parts 32, 34, 32', 34' of the outer light housing 30, 30' are attached together with the trigger guard of the handgun in the second cavity 32F, 34F thereof and with the mounting rail of the handgun in the rail recess 16', 33R, 35R; the outer light housing 30, 30' having one or more openings 12 at a second end thereof through which light produced by the illumination light source 120 and the laser aiming light source 130 may be emitted; and the outer light housing 30, 30' having an opening 32A, 34A through which the at least one electrical switch 146 of the light module 100 is actuatable from outside the outer light housing 30, 30'. The outer light housing 30, 30' may include an access cover 36 on an exterior surface thereof that is not adjacent the handgun, the access cover 36 being openable when the light is mounted on a handgun for placing a source of electrical power 150 into the light module housing 110 and for removing the source of electrical power 150 from the light module housing 110. The access cover 36 may be closable to retain the source of electrical power 150 in the light module housing 110; or the access cover 36 may be pivotably attached to one of the first and second complementary housing parts 32, 34, 32', 34' of the outer light housing 30, 30'; or the access cover 36 may be closable to retain the source of electrical power 150 in the light module housing 110 and may be pivotably attached to one of the first and second complementary housing parts 32, 34, 32', 34' of the outer light housing 30, 30'. The light 10,10' mountable on a handgun may further comprise a movable member 36M disposed between the access cover 36 and a side of the source of electrical power 150, wherein the movable member 36M biases the source of electrical power 150 against a surface of the light module 100. The movable member 36M may bias the source of electrical power 150 against an electrical contact of the light module 100 so that the side of the source of electrical power 150 makes an electrical connection to the electrical contact. The first and second complementary housing parts 32, 34, 32', 34' of the outer light housing 30, 30' may be attached together by one or more threaded fasteners 38, wherein tightening the one or more threaded fasteners 38 clamps the trigger guard of the handgun in the cavity therefor defined by the first and second complementary housing parts 32, 34, 32', 34' and clamps the mounting rail of the handgun in the rail recess 16', 33R, 35R therefor defined by the first and second complementary housing parts 32, 34, 32', 34'. The part of the handgun for which the cavity 32F, 34F of the outer light housing 30, 30' is configured may include a trigger guard. The light 10,10' mountable on a handgun may be in combination with at least a second outer light housing 30, 30' having first and second complementary housing parts 32', 34' for enclosing the light module 100, the first and second complementary housing parts 32', 34' of the second outer light housing 30, 30' cooperating when together to define at a first end of the outer light housing 30, 30' a second cavity 32F, 34F configured to correspond to the size and shape of a trigger guard of a different handgun than does the outer light housing 30, 30' and to define at an upper end or part thereof a rail recess 16', 33R, 35R configured to correspond to the mounting rail of the different handgun. The light module 100 may include an azimuth adjusting screw 136A and an elevation adjusting screw 136E for aiming the laser light source 130 in azimuth and elevation, respectively, and the outer light housing 30, 30' may have one or more openings 136 through which an azimuth adjusting screw 136A and the elevation adjusting screw 136E can be adjusted. Each of the first and second complementary housing parts 32, 32', 34, 34' may have an inwardly directed flange 33', 35' at the upper end or part thereof, the respective inwardly directed flanges 33', 35' of the first and second complementary housing parts 32, 32', 34, 34' cooperate to define at the upper part of the outer light housing the rail recess 16', 33R, 35R configured to correspond in size and shape to the mounting rail of the handgun.

A light 10,10' mountable on a handgun may comprise: a light housing 30, 30' first and second complementary housing parts 32, 34, 32', 34' that cooperate when together to define at a first end of the light housing 30, 30' a first cavity configured to correspond to the size and shape of a trigger guard of the handgun and to define at an upper part of the light housing 30, 30' a rail recess configured to correspond in size and shape to a mounting rail of the handgun; the light housing 30, 30' including therein an illumination light source 120 or a laser aiming light source 130 or both 120, 130, at least one electrical switch 146, and a control circuit 140 for selectively energizing the illumination light source 120, the laser aiming light source 130 or both the illumination and laser aiming light sources 120, 130, the light housing defining a cavity for receiving a source of electrical power 150; whereby the light 10,10' is mountable to the trigger guard and mounting rail of the handgun when the first and second complementary housing parts 32, 34, 32', 34' of the light housing 30, 30' are attached together with the trigger guard of the handgun in the first cavity 32F, 34F thereof and with the mounting rail in the rail recess 16' 33R, 35R thereof; the light housing 30, 30' having one or more openings 12 at a second end thereof through which light produced by the illumination light source 120, by the laser aiming light source 130, or by both the illumination and laser aiming light sources 120, 130 may be emitted; and the light housing 30, 30' having an opening 32A, 34A through which the at least one electrical switch 146 of the light module 100 is actuatable from outside the outer light housing 30, 30'. The light housing 30, 30' may include an access cover 36 on an exterior surface thereof that is not adjacent the handgun, the access cover 36 being openable when the light 10,10' is mounted on a handgun for placing a source of electrical power 150 into the light module housing 110 and for removing the source of electrical power 150 from the light module housing 110. The access cover 36 may be closable to retain the source of electrical power 150 in the light module housing 110; or the access cover 36 may be pivotably attached to one of the first and second complementary housing parts 32, 34, 32', 34' of the light housing 30, 30; or the access cover 36 may be closable to retain the source of electrical power 150 in the light module housing 110 and may be pivotably attached to one of the first and second complementary housing parts 32, 34, 32', 34' of the light housing 30, 30'. The light 10,10' mountable on a handgun may further comprise a movable member 36M disposed between the access cover 36 and a side of the source of electrical power 150, wherein the movable member 36M biases the source of electrical power 150 against a surface of the control circuit 200. The movable member 36M may bias the source of electrical power 150 against an electrical contact of the control circuit 140 so that the side of the source of electrical power 150 makes an electrical connection to the electrical contact. The first and second complementary housing parts 32, 34, 32', 34' of the light housing 30, 30' may be attached together by one or more threaded fasteners 38, wherein tightening the one or more threaded fasteners 38 clamps the trigger guard of the handgun in first cavity defined by the first and second complementary housing parts 32, 34, 32', 34' and clamps the mounting rail of the handgun in the rail recess 16' 33R, 35R defined by the first and second complementary housing parts 32, 34, 32', 34'. The light module 100 may include an azimuth adjusting screw 136A and an elevation adjusting screw 136E for aiming the laser light source 130 in azimuth and elevation, respectively, the outer light housing 30, 30' having one or more openings through which an azimuth adjusting screw 136A and the elevation adjusting screw 136E can be adjusted. The light housing 30, 30' may include: a light module 100 including a light module housing 110 supporting the illumination light source 120 and/or the laser aiming light source 130, the at least one electrical switch 146, and the control circuit 140 for selectively energizing the illumination light source 120 and/or the laser aiming light source 130, wherein the light module housing 110 defines the second cavity for receiving a source of electrical power 150; and wherein the first and second complementary housing parts 32, 32', 34, 34' enclose the light module 100. The light 10 mountable on a handgun may be in combination with at least a second light housing 30, 30' having first and second complementary housing parts 32, 32', 34, 34' for enclosing therein the illumination light source 120 or the laser aiming light source 130 or both 120, 130, the at least one electrical switch 146, and the control circuit 140 for selectively energizing the illumination light source 120, the laser aiming light source 130, or both the illumination and laser aiming light sources 120, 130, the second light housing 30, 30' defining a second cavity for receiving the source of electrical power 150, the first and second complementary housing parts 32, 32', 34, 34' of the second light housing 30, 30' cooperate when together to define at a first end of the second light housing 30, 30' a cavity 32F, 34F configured to correspond to the size and shape of a trigger guard of a different handgun than does the light housing 30, 30' and to define at an upper end or part thereof a rail recess 16', 33R, 35R configured to correspond to a mounting rail of the different handgun.

A light 10,10' mountable on a handgun may comprise: a light housing 30, 30' having first and second complementary housing parts 32, 32', 34, 34' that define a first cavity 32F, 32T, 34F, 34T configured to correspond in size and shape to a trigger guard of the handgun and define a rail recess 16', 33R, 35R configured to correspond in size and shape to a mounting rail of the handgun; the light housing 30, 30' includes an illumination light source 120 or a laser aiming light source 130 or both, at least one electrical switch 146, and a control circuit 140 for selectively energizing the illumination light source 120, the laser aiming light source 130, or both; whereby the light 10, 10' is mountable to the trigger guard and mounting rail of the handgun when the first and second complementary housing parts 32, 32', 34, 34' of the light housing 30, 30' are attached together with the trigger guard of the handgun in the first cavity thereof and with the mounting rail in the rail recess thereof; the light housing 30, 30' may have one or more openings through which light produced by the illumination light source 120, by the laser aiming light source 130, or by both, may be emitted; and the light housing 30, 30' having an opening through which the at least one electrical switch 146 is actuatable from outside the light housing 30, 30'. The light housing may include an access cover 36 on an exterior surface thereof configured to be openable when the light 10, 10' is mounted on a handgun for placing and removing a source of electrical power 150 into the light housing 30, 30'. The first and second complementary housing parts 32, 32', 34, 34' of the light housing are attached together by one or more fasteners 38, wherein tightening the one or more fasteners 38 clamps the trigger guard of the handgun in the first and second complementary housing parts 32, 32', 34, 34' and clamps the mounting rail of the handgun in the rail recess 16', 33R, 35R of the first and second complementary housing parts 32, 32', 34, 34'. The light housing 30, 30' may include: a light module 100 including a light module housing 110 supporting the illumination light source 120 and the laser aiming light source 130, the at least one electrical switch 146, and the control circuit 140, and wherein the light module housing 110 defines a cavity for receiving a source of electrical power 150; and wherein the first and second complementary housing parts 32, 32', 34, 34' enclose the light module 100. The light 10, 10' mountable on a handgun may be in combination with at least a second light housing 30, 30' having first and second complementary housing parts 32, 32', 34, 34' for enclosing therein the illumination light source 120 or the laser aiming light source 130 or both, the at least one electrical switch 146, and the control circuit 140, the first and second complementary housing parts 32, 32', 34, 34' of the second light housing 330, 30' cooperating when together to define a cavity 32F, 32T, 34F, 34T configured to correspond to the trigger guard of a different handgun than does the first recited light housing 30, 30' and to define a rail recess 16', 33R, 35R configured to correspond to a mounting rail of the different handgun.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "up," "down," "left," "right," "up," "down," "front," "rear," "side," "end," "top," "bottom," "forward," "backward," "under" and/or "over," "vertical," "horizontal," and the like may be used herein as a convenience in describing one or more embodiments and/or uses of the present arrangement, e.g., the position of light 10,10' when mounted to a handgun in a common position under the barrel thereof, the articles described may be positioned in any desired orientation and/or may be utilized in any desired position and/or orientation. Such terms of position and/or orientation should be understood as being for convenience only, and not as limiting of the invention as claimed.

The term battery is used herein to refer to an electrochemical device comprising one or more electro-chemical cells and/or fuel cells, and so a battery may include a single cell or plural cells, whether as individual units or as a packaged unit. A battery is one example of a type of an electrical power source suitable for a portable device. Other devices could include fuel cells, super capacitors, solar cells, and the like. Any of the foregoing may be intended for a single use or for being rechargeable or for both Various embodiments of a battery may have one or more battery cells, e.g., one, two, three, four, or five or more battery cells, as may be deemed suitable for any particular device. A battery may employ various types and kinds of battery chemistry types, e.g., a carbon-zinc, alkaline, lead acid, nickel-cadmium (Ni—Cd), nickel-metal-hydride (NiMH) or lithium-ion (Li-Ion) battery type, of a suitable number of cells and cell capacity for providing a desired operating time and/or lifetime for a particular device, and may be intended for a single use or for being rechargeable or for both. Examples may include a three or six cell lead acid battery typically producing about 6 volts or about 12 volts, a three cell Ni—Cd battery typically producing about 3.6 volts, a four cell NiMH battery typically producing about 4.8 volts, a five cell NiMH battery producing about 6 volts, a Li-Ion battery typically producing about 3.5 volts, or a two-cell Li-Ion battery typically producing about 7 volts, e.g., two ⅓ "N" cell lithium batteries, it being noted that the voltages produced thereby will be higher when approaching full charge and will be lower in discharge, particularly when providing higher current and when reaching a low level of charge, e.g., becoming discharged.

The term DC converter is used herein to refer to any electronic circuit that receives at an input electrical power at one voltage and current level and provides at an output DC electrical power at a different voltage and/or current level. Examples may include a DC-DC converter, an AC-DC converter, a boost converter, a buck converter, a buck-boost converter, a single-ended primary-inductor converter (SEPIC), a series regulating element, a current level regulator, and the like. The input and output thereof may be DC coupled and/or AC coupled, e.g., as by a transformer and/or capacitor. A DC converter may or may not include circuitry for regulating a voltage and/or a current level, e.g., at an output thereof, and may have one or more outputs providing electrical power at different voltage and/or current levels and/or in different forms, e.g., AC or DC.

A fastener as used herein may include any fastener or other fastening device that may be suitable for the described use, including threaded fasteners, e.g., bolts, screws and driven fasteners, as well as pins, rivets, nails, spikes, barbed fasteners, clips, clamps, nuts, speed nuts, cap nuts, acorn nuts, and the like. Where it is apparent that a fastener would be removable in the usual use of the example embodiment described herein, then removable fasteners would be preferred is such instances. A fastener may also include, where appropriate, other forms of fastening such as a formed head, e.g., a peened or swaged or heat formed head, a weld, e.g., a heat weld or ultrasonic weld, a braze, and the like.

While the present invention has been described in terms of the foregoing example embodiments, variations within the scope and spirit of the present invention as defined by the claims following will be apparent to those skilled in the art. For example, while light 10,10' preferably includes both illumination light source 120 and aiming laser light source 130, in an embodiment for a particular application, light 10,10' could include either illumination light source 120 or aiming laser light source 130, but not both.

While illumination light source 120 is illustrated in an upper or over position and laser light source 130 in a lower or under position, these positions may be reversed, or may be made side-by-side, if desired. Similarly, while switch actuating buttons 14 are preferably provided on both the left and right sides of light 10,10', only one switch actuating button need be provided and it could be located in a position as or near as illustrated or could be in a different location.

Battery cover 36 may be made of an electrically conductive material so as to make electrical connection to the side or end of lower battery 150 with which it is in physical contact, or a separate electrical contact may be provided on a battery cover 36. In a further alternative, movable member 36M may be part of and/or attached to battery access cover 36, e.g., a raised part thereof or a resilient bump attached thereto, rather than a separate piece.

While certain features may be described as a raised feature, e.g., a ridge, boss, flange, projection or other raised feature, such feature may be positively formed or may be what remains after a recessed feature, e.g., a groove, slot, hole, indentation, recess or other recessed feature, is made. Similarly, while certain features may be described as a recessed feature, e.g., a groove, slot, hole, indentation, recess or other recessed feature, such feature may be positively formed or may be what remains after a raised feature, e.g., a ridge, boss, flange, projection or other raised feature, is made.

Each of the U.S. Provisional Applications, U.S. Patent Applications, and/or U.S. patents, identified herein is hereby incorporated herein by reference in its entirety, for any purpose and for all purposes irrespective of how it may be referred to or described herein.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A light mountable on a handgun comprising:

a light module including a light module housing supporting one or more light sources, at least one electrical switch, and a control circuit for selectively energizing said one or more light sources, wherein said light module defines a first cavity for receiving a source of electrical power;

an outer light housing having first and second complementary housing parts enclosing said light module, the first and second complementary housing parts cooperating when together to define at a first end of the outer light housing a second cavity configured to correspond in size and shape to a first part of the handgun and to define at an upper part of said outer light housing a rail recess configured to correspond in size and shape to a mounting rail of the handgun;

whereby said light is mountable to the handgun when the first and second complementary housing parts of the outer light housing are attached together with the part of the handgun in the second cavity thereof and with the mounting rail of the handgun in the rail recess thereof;

said outer light housing having one or more openings at a second end thereof through which light produced by said one or more light sources may be emitted;

said outer light housing having an opening through which the at least one electrical switch of said light module is actuatable from outside said outer light housing;

said outer light housing including an access cover on an exterior surface thereof that is not adjacent the handgun, said access cover being openable when said light is mounted on a handgun for placing a source of electrical power into the light module and for removing the source of electrical power from the light module; and a movable member disposed between said access cover and a side of the source of electrical power, wherein said movable member is not an electrical contact and biases the source of electrical power against an electrical contact of said light module.

2. The light mountable on a handgun of claim 1 wherein the one or more light sources of said light module include:

an illumination light source, or a laser aiming light source; or an illumination light source and a laser aiming light source.

3. The light mountable on a handgun of claim 1 wherein the first and second complementary housing parts of said outer light housing are attached together by one or more threaded fasteners, wherein tightening the one or more threaded fasteners clamps the part of the handgun in the first cavity defined by said first and second complementary housing parts and clamps the mounting rail in the rail recess defined by said first and second complementary housing parts.

4. The light mountable on a handgun of claim 1 wherein the part of the handgun for which the cavity of said outer light housing is configured includes a trigger guard.

5. The light mountable on a handgun of claim 1 wherein;

said access cover is closable to retain the source of electrical power in said light module; or said access cover is pivotably attached to one of the first and second complementary housing parts of said outer light housing; or said access cover is closable to retain the source of electrical power in said light module and is pivotably attached to one of the first and second complementary housing parts of said outer light housing.

6. The light mountable on a handgun of claim 1 wherein said movable member biases the source of electrical power against the electrical contact of said light module so that the side of the source of electrical power makes an electrical connection to the electrical contact.

7. The light mountable on a handgun of claim 1 in combination with at least a second outer light housing having first and second complementary housing parts for enclosing said light module, the first and second complementary housing parts of said second outer light housing cooperating when together to define at a first end of the outer light housing a cavity configured to correspond to the size and shape of a part of a different handgun than does the outer light housing of claim 1 and to define at an upper part thereof a rail recess configured to correspond to a mounting rail of the different handgun.

8. The light mountable on a handgun of claim 2 wherein said light module includes an azimuth adjusting screw and an elevation adjusting screw for aiming said laser light source in azimuth and elevation, respectively, said outer light housing having one or more openings through which the azimuth adjusting screw and the elevation adjusting screw can be adjusted.

9. The light mountable on a handgun of claim 1 wherein each of said first and second complementary housing parts has an inwardly directed flange at the upper part thereof, the respective inwardly directed flanges of said first and second complementary housing parts cooperating to define at the upper part of said outer light housing the rail recess configured to correspond in size and shape to the mounting rail of the handgun.

10. A light mountable on a handgun comprising:

a light module including in a light module housing: an illumination light source and a laser aiming light source, at least one electrical switch, and a control circuit for selectively energizing said illumination light source and said laser aiming light source, said light module defining a first cavity for receiving a source of electrical power;

an outer light housing having first and second complementary housing parts enclosing said light module, the first and second complementary housing parts cooperating when together to define at a first end of the outer light housing a second cavity configured to correspond to the size and shape of a trigger guard of the handgun and to define at an upper part of said outer light housing a rail recess configured to correspond in size and shape to a mounting rail of the handgun;

whereby said light is mountable to the handgun when the first and second complementary housing parts of the outer light housing are attached together with the trigger guard of the handgun in the second cavity thereof and with the mounting rail of the handgun in the rail recess thereof;

said outer light housing having one or more openings at a second end thereof through which light produced by said illumination light source and said laser aiming light source may be emitted;

said outer light housing having an opening through which the at least one electrical switch of said light module is actuatable from outside said outer light housing;

said outer light housing including an access cover on an exterior surface thereof that is not adjacent the handgun, said access cover being openable when said light is mounted on a handgun for placing a source of electrical power into the light module and for removing the source of electrical power from the light module; and a movable member disposed between said access cover and a side of the source of electrical power, wherein said movable member is not an electrical contact and biases the source of electrical power against an electrical contact of said light module.

11. The light mountable on a handgun of claim 10 wherein:

said access cover is closable to retain the source of electrical power in said light module; or said access cover is pivotably attached to one of the first and second complementary housing parts of said outer light housing; or said access cover is closable to retain the source of electrical power in said light module and is pivotably attached to one of the first and second complementary housing parts of said outer light housing.

12. The light mountable on a handgun of claim 10 wherein said movable member biases the source of electrical power against the electrical contact of said light module so that the side of the source of electrical power makes an electrical connection to the electrical contact.

13. The light mountable on a handgun of claim 10 wherein the first and second complementary housing parts of said outer light housing are attached together by one or more threaded fasteners, wherein tightening the one or more threaded fasteners clamps the trigger guard of the handgun in the second cavity defined by said first and second complementary housing parts and clamps the mounting rail in the rail recess defined by said first and second complementary housing parts.

14. The light mountable on a handgun of claim 10 in combination with at least a second outer light housing having first and second complementary housing parts for enclosing said light module, the first and second complementary housing parts of said second outer light housing cooperating when together to define at a first end of the outer light housing a cavity configured to correspond to the size and shape of a trigger guard of a different handgun than does the outer light housing of claim 10 and to define at an upper part thereof a rail recess configured to correspond to a mounting rail of the different handgun.

15. The light mountable on a handgun of claim 10 wherein said light module includes an azimuth adjusting screw and an elevation adjusting screw for aiming said laser light source in azimuth and elevation, respectively, said outer light housing having one or more openings through which the azimuth adjusting screw and the elevation adjusting screw can be adjusted.

16. The light mountable on a handgun of claim 10 wherein each of said first and second complementary housing parts has an inwardly directed flange at the upper part thereof, the respective inwardly directed flanges of said first and second complementary housing parts cooperating to define at the upper part of said outer light housing the rail recess configured to correspond in size and shape to the mounting rail of the handgun.

17. A light mountable on a handgun comprising:

a light housing having first and second complementary housing parts that cooperate when together to define at a first end of said light housing a first cavity configured to correspond in size and shape to a trigger guard of the handgun and to define at an upper part of said light housing a rail recess configured to correspond in size and shape to a mounting rail of the handgun;

said light housing including therein an illumination light source or a laser aiming light source or both, at least one electrical switch, and a control circuit for selectively energizing said illumination light source, said laser aiming light source, or both said illumination and laser aiming light sources, said light housing defining a second cavity for receiving a source of electrical power;

whereby said light is mountable to the trigger guard and mounting rail of the handgun when the first and second complementary housing parts of said light housing are attached together with the trigger guard of the handgun in the first cavity thereof and with the mounting rail in the rail recess thereof;

said light housing having one or more openings at a second end thereof through which light produced by said illumination light source, by said laser aiming light source, or by both said illumination and said laser aiming light sources may be emitted;

said light housing having an opening through which the at least one electrical switch is actuatable from outside said light housing;

said light housing including an access cover on an exterior surface thereof that is not adjacent the handgun, said access cover being openable when said light is mounted on a handgun for placing a source of electrical power into the second cavity of said light housing and for removing the source of electrical power from the second cavity of said light housing; and a movable member disposed between said access cover and a side of the source of electrical power, wherein said movable member is not an electrical contact and biases the source of electrical power against an electrical contact of said control circuit.

18. The light mountable on a handgun of claim 17 wherein:

said access cover is closable to retain the source of electrical power in said light housing; or said access cover is pivotably attached to one of the first and second complementary housing parts of said light housing; or said access cover is closable to retain the source of electrical power in said light housing and is pivotably attached to one of the first and second complementary housing parts of said light housing.

19. The light mountable on a handgun of claim 17 wherein said movable member biases the source of electrical power against the electrical contact of said control circuit so that the side of the source of electrical power makes an electrical connection to the electrical contact.

20. The light mountable on a handgun of claim 17 wherein the first and second complementary housing parts of said light housing are attached together by one or more fasteners, wherein tightening the one or more fasteners clamps the trigger guard of the handgun in the first cavity defined by said first and second complementary housing parts and clamps the mounting rail of the handgun in the rail recess defined by said first and second complementary housing parts.

21. The light mountable on a handgun of claim 17 wherein said light housing further includes an azimuth adjusting screw and an elevation adjusting screw for aiming said laser light source in azimuth and elevation, respectively, said light housing having one or more openings through which the azimuth adjusting screw and the elevation adjusting screw can be adjusted.

22. The light mountable on a handgun of claim 17 wherein said light housing includes:

a light module including a light module housing supporting the illumination light source and the laser aiming light source, the at least one electrical switch, and the control circuit for selectively energizing said illumination light source and said laser aiming light source, and wherein said light module housing defines the second cavity for receiving a source of electrical power; and wherein said first and second complementary housing parts enclose said light module.

23. The light mountable on a handgun of claim 17 in combination with at least a second light housing having first and second complementary housing parts for enclosing therein the illumination light source or the laser aiming light source or both, the at least one electrical switch, and the control circuit for selectively energizing the illumination light source, the laser aiming light source, or both the illumination and laser aiming light sources, the second light housing defining a second cavity for receiving a source of electrical power, the first and second complementary housing parts of said second light housing cooperating when together to define at a first end of the light housing a cavity configured to correspond to the size and shape of a trigger guard of a different handgun than does the light housing of claim 19 and to define at an upper part thereof a rail recess configured to correspond to a mounting rail of the different handgun.

24. A light mountable on a handgun comprising:

a light housing having first and second complementary housing parts that define a first cavity configured to correspond in size and shape to a trigger guard of the handgun and define a rail recess configured to correspond in size and shape to a mounting rail of the handgun;

said light housing including an illumination light source or a laser aiming light source or both, at least one electrical switch, and a control circuit for selectively energizing said illumination light source, said laser aiming light source, or both;

whereby said light is mountable to the trigger guard and mounting rail of the handgun when the first and second complementary housing parts of said light housing are attached together with the trigger guard of the handgun in the first cavity thereof and with the mounting rail in the rail recess thereof;

said light housing having one or more openings through which light produced by said illumination light source, by said laser aiming light source, or by both, may be emitted;

said light housing having an opening through which the at least one electrical switch is actuatable from outside said light housing;

said light housing including an access cover on an exterior surface thereof configured to be openable when said light is mounted on a handgun for placing and removing a source of electrical power into said light housing; and a movable member disposed between said access cover and a side of the source of electrical power, wherein said movable member is not an electrical contact and biases the source of electrical power against an electrical contact of said control circuit.

25. The light mountable on a handgun of claim 24 wherein the first and second complementary housing parts of said light housing are attached together by one or more fasteners, wherein tightening the one or more fasteners clamps the trigger guard of the handgun in said first and second complementary housing parts and clamps the mounting rail of the handgun in the rail recess of said first and second complementary housing parts.

26. The light mountable on a handgun of claim 24 wherein said light housing includes:

a light module including a light module housing supporting the illumination light source and the laser aiming light source, the at least one electrical switch, and the control circuit, and wherein said light module housing defines a cavity for receiving a source of electrical power; and wherein said first and second complementary housing parts enclose said light module.

27. The light mountable on a handgun of claim 24 in combination with at least a second light housing having first and second complementary housing parts for enclosing therein the illumination light source or the laser aiming light source or both, the at least one electrical switch, and the control circuit, the first and second complementary housing parts of said second light housing cooperating when together to define a cavity configured to correspond to the trigger guard of a different handgun than does the light housing of claim 24 and to define a rail recess configured to correspond to a mounting rail of the different handgun.

* * * * *